US011745514B2

(12) United States Patent
Okamura et al.

(10) Patent No.: US 11,745,514 B2
(45) Date of Patent: Sep. 5, 2023

(54) PRESSURE ADJUSTMENT UNIT, LIQUID EJECTING HEAD, AND LIQUID EJECTING APPARATUS

(71) Applicant: Seiko Epson Corporation, Tokyo (JP)

(72) Inventors: Yu Okamura, Matsumoto (JP); Yoshiki Sugawara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 17/652,143

(22) Filed: Feb. 23, 2022

(65) Prior Publication Data

US 2022/0274421 A1 Sep. 1, 2022

(30) Foreign Application Priority Data

Feb. 26, 2021 (JP) ..... 2021-029754

(51) Int. Cl.
*B41J 2/175* (2006.01)

(52) U.S. Cl.
CPC ..... *B41J 2/17596* (2013.01)

(58) Field of Classification Search
CPC .... B41J 2/17596; B41J 2/175; B41J 2/17509; B41J 29/13; B41J 2202/05
See application file for complete search history.

(56) References Cited

U.S. PATENT DOCUMENTS 11,292,256 B2 * 4/2022 Nakajima ..... B41J 2/175
11,529,813 B2 * 12/2022 Sato ..... B41J 2/17596
11,618,260 B2 * 4/2023 Shinoda ..... B41J 2/18 347/33
2006/0221147 A1 10/2006 Okazaki et al.

FOREIGN PATENT DOCUMENTS

JP 2006-306014 11/2006
JP 2018-094831 6/2018
JP 2019-198999 11/2019

* cited by examiner

*Primary Examiner* — An H Do
(74) *Attorney, Agent, or Firm* — WORKMAN NYDEGGER

(57) ABSTRACT

A pressure adjustment unit includes a flow passage including a first chamber, a second chamber, and a through hole. The apparatus further includes a partition wall that the through hole is formed, a first sealing portion having flexibility, a second sealing portion facing with the first sealing portion, a valve configured to close the flow passage by moving in a first direction, and to open the flow passage by moving in a second direction opposite to the first direction, a biasing member biasing the valve in the first direction, and a restricting portion restricting movement of the valve in the first direction by contact with a to-be-restricted portion of the valve, at a second portion different from a first portion where contact of the first sealing portion and the second sealing portion occurs.

12 Claims, 14 Drawing Sheets

PRESSURE ADJUSTMENT UNIT, LIQUID EJECTING HEAD, AND LIQUID EJECTING APPARATUS

The present application is based on, and claims priority from JP Application Serial Number 2021-029754, filed Feb. 26, 2021, the disclosure of which is hereby incorporated by reference herein in its entirety.

BACKGROUND

1. Technical Field

Embodiments of the present disclosure relate to a pressure adjustment unit inside which a valve is provided, a liquid ejecting head configured to eject a liquid, and a liquid ejecting apparatus.

2. Related Art

An ink-jet recording apparatus that performs printing on an ejection target medium such as paper or a recording sheet, etc. by ejecting ink, an example of a liquid, onto the ejection target medium is known as an example of a liquid ejecting apparatus.

In some of such ink-jet recording apparatuses, ink is supplied from a liquid containing unit such as an ink tank to an ink-jet recording head via supply conduit members such as tubes, and the ink supplied from the liquid containing unit is ejected from nozzles of the ink-jet recording head in the form of ink droplets. An apparatus that has been proposed in related art, for example, as disclosed in JP-A-2018-094831, is equipped with a pressure adjustment unit that includes a valve provided inside on the route of a flow passage to ensure that ink supplied from a liquid containing unit will be supplied to an ink-jet recording head with constant pressure.

However, there is the following problem in related art. Since the valve is urged by a spring for the purpose of closing the flow passage, stress acts for a long time on a flexible member configured to provide sealing, and the stress acting over time causes creep deformation of the flexible member. This might result in poor valve closure.

The problem described above is not limited to a pressure adjustment unit used in a liquid ejecting head, a typical example of which is an ink-jet recording head. The problem described above could occur also in a pressure adjustment unit used in other devices.

SUMMARY

A certain aspect of the present disclosure is a pressure adjustment unit, comprising: a flow passage that includes a first chamber, a second chamber, and a through hole through which a liquid flows from the first chamber to the second chamber; a partition wall which provides separation between the first chamber and the second chamber and through which the through hole is formed; a first sealing portion having flexibility; a second sealing portion facing with the first sealing portion; a valve that closes the flow passage by contact of the first sealing portion and the second sealing portion by moving in a first direction, which is a direction from the first chamber toward the second chamber, and opens the flow passage by releasing the contact of the first sealing portion and the second sealing portion by moving in a second direction, which is an opposite of the first direction; a biasing member that biases the valve in the first direction; and a restricting portion that restricts movement of the valve in the first direction by contact with a to-be-restricted portion of the valve, at a second portion different from a first portion where the contact of the first sealing portion and the second sealing portion occurs.

Another aspect of the present disclosure is a liquid ejecting head, comprising: the pressure adjustment unit according to the above aspect; and a nozzle from which a liquid supplied from the second chamber of the pressure adjustment unit according to the above aspect is ejected.

Another aspect of the present disclosure is a liquid ejecting apparatus, comprising: the pressure adjustment unit according to the above aspect; a liquid containing unit that contains a liquid that is supplied to the first chamber of the pressure adjustment unit according to the above aspect; and a nozzle from which a liquid supplied from the second chamber of the pressure adjustment unit according to the above aspect is ejected.

DESCRIPTION OF EXEMPLARY EMBODIMENTS

Figure 1:
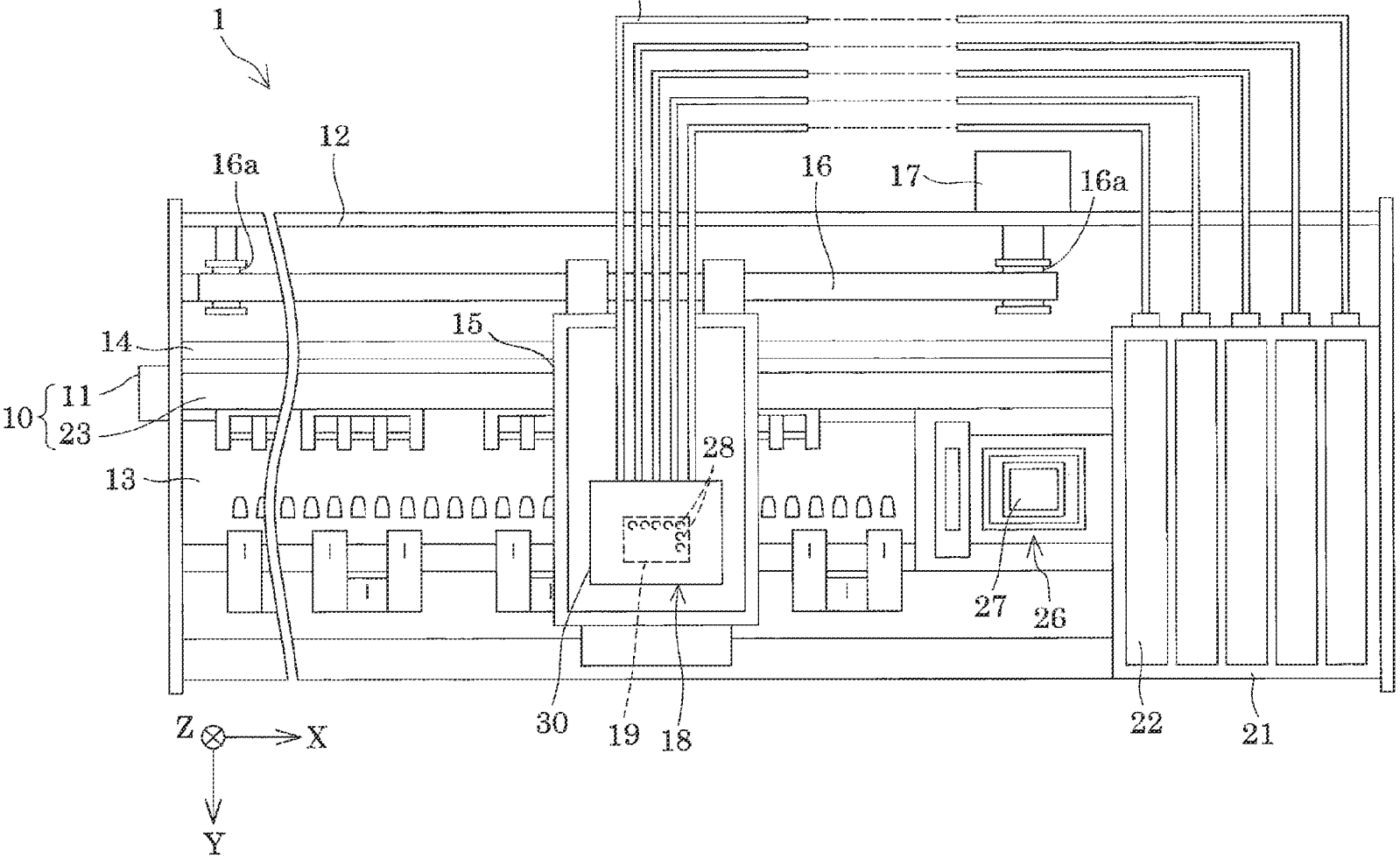
FIG. 1 is a plan view of a schematic structure of a recording apparatus according to a first embodiment.

Some embodiments of the present disclosure will now be explained in detail. The description below merely shows a certain aspect of the present disclosure. As such, the described aspect may be modified as needed within the scope of the present disclosure. In the figures, the same members are labeled with the same reference numerals, and description of the same members will be omitted below. In the figures, X, Y, and Z represent three spatial axes orthogonal to one another. In this specification, directions along these axes are defined as X, Y, and Z directions. The direction indicated by an arrow in each figure will be described as a positive direction (+). The opposite direction will be described as a negative direction (−). The three X, Y, and Z spatial axes will be referred to as X, Y, and Z axes when their positive/negative directional polarity is not limited. In each of the following embodiments, as an example, "a first direction" is described as a −Z direction, and "a second direction" is described as a +Z direction.

First Embodiment

FIG. 1 is a plan view of a schematic structure of an ink-jet recording apparatus 1, which is an example of "a liquid ejecting apparatus" according to a first embodiment of the present disclosure.

As illustrated in FIG. 1, the ink-jet recording apparatus 1, an example of "a liquid ejecting apparatus", is a printer that ejects ink, which is a kind of a liquid, in the form of ink droplets, and causes the ink droplets to land onto the surface of a medium such as printing paper (not illustrated) to form a pattern of dots on the medium, thereby printing an image, etc. The medium is not limited to recording paper. Any material such as a resin film or a cloth may be used.

The ink-jet recording apparatus 1 described briefly above has a body frame 12 having a rectangular shape in a plan view. A medium supporting member 13 configured to support a medium (not illustrated) is provided inside the body frame 12 in such a way as to extend in a main scan direction, which is the X direction. A medium is fed on the medium supporting member 13 in a sub scan direction, which is the Y direction, by a transportation unit 10 comprised of a medium roller 23 and a medium roller motor 11 configured to drive the medium roller 23. A guiding shaft 14 having a rod shape is provided inside the body frame 12 on the −Z directional side with respect to the medium supporting member 13. The guiding shaft 14 extends in parallel with the X axis.

A carriage 15 is supported on the guiding shaft 14 such that it is able to reciprocate along the X axis, that is, in a state of being able to move in the −X direction and the +X direction. The carriage 15 is indirectly connected to a carriage motor 17, which is provided on the body frame 12, via an endless timing belt 16 stretched around and between a pair of pulleys 16*a* provided on the body frame 12. With the above structure, the carriage 15 reciprocates along the guiding shaft 14 when driven by the carriage motor 17.

A head unit 18 is provided on the −Z directional side of the carriage 15 in such a way as to face the medium supporting member 13. The head unit 18 includes an ink-jet recording head (hereinafter may be simply referred to as "recording head") 19, which is an example of "a liquid ejecting head" according to the present embodiment, and a pressure adjustment unit 30, which adjusts the pressure of ink that is to be supplied to the recording head 19.

A plurality of nozzles 28 is provided on, of the recording head 19, the +Z-side surface facing the medium supporting member 13. Piezoelectric actuators, which are drive elements provided in the recording head 19, are driven, and, as a result of the driving, ink droplets are ejected from the respective nozzles 28 toward a medium on the medium supporting member 13, to perform printing thereon.

Liquid containers 22, an example of "a liquid containing unit", are individual containers. Specifically, ink that is to be ejected from the recording head 19 is contained in the liquid containers 22 either individually on an ink-color-by-ink-color basis or individually on an ink-type-by-ink-type basis. For example, an ink cartridge that can be detachably attached to the ink-jet recording apparatus 1, a bag-type ink pack made of a flexible film, an ink tank which can be refilled with ink, etc. may be used as the liquid container 22. In the present embodiment, the number of the liquid containers 22 is five.

The plurality of liquid containers 22 is detachably attached to a liquid container holder 21 provided at the +X-side end portion of the body frame 12. That is, the liquid containers 22 according to the present embodiment are ink cartridges. Each of the plurality of liquid containers 22 attached to the liquid container holder 21 is connected to the pressure adjustment unit 30 via a supply conduit member 24 such as a tube. The pressure adjustment unit 30 adjusts the pressure of ink that is supplied from each liquid container 22 via the corresponding supply tube 24, and supplies the pressure-adjusted ink to the recording head 19. Although a single pressure adjustment unit only is illustrated as the pressure adjustment unit 30 in FIG. 1, the pressure adjustment unit 30 is provided individually for each color or each type of ink that is supplied from the liquid container 22. In the present embodiment, the liquid container holder 21 is provided on the body frame 12.

However, the scope of the present disclosure is not limited to this example. The liquid container holder 21 may be provided on the carriage 15.

A maintenance unit 26 for performing maintenance such as the cleaning of the recording head 19 is provided at a home-position area of the carriage 15, which is near the +X-side end inside the body frame 12. The maintenance unit 26 includes a cap 27 and a suction pump (not illustrated). The suction pump is capable of sucking the inside of the cap 27. The cap 27 is configured to be brought into contact with the recording head 19 in such a way as to enclose the nozzles 28 of the recording head 19, and is configured to receive ink ejected from the nozzles 28 due to flushing. An operation for forcibly discharging ink whose viscosity has increased, air bubbles, etc. into the cap 27, namely, so-called cleaning, can be performed by applying a suction force to the inside of the cap 27 while the cap 27 is in contact with the recording head 19 in such a way as to enclose the nozzles 28 of the recording head 19.

Figure 2:
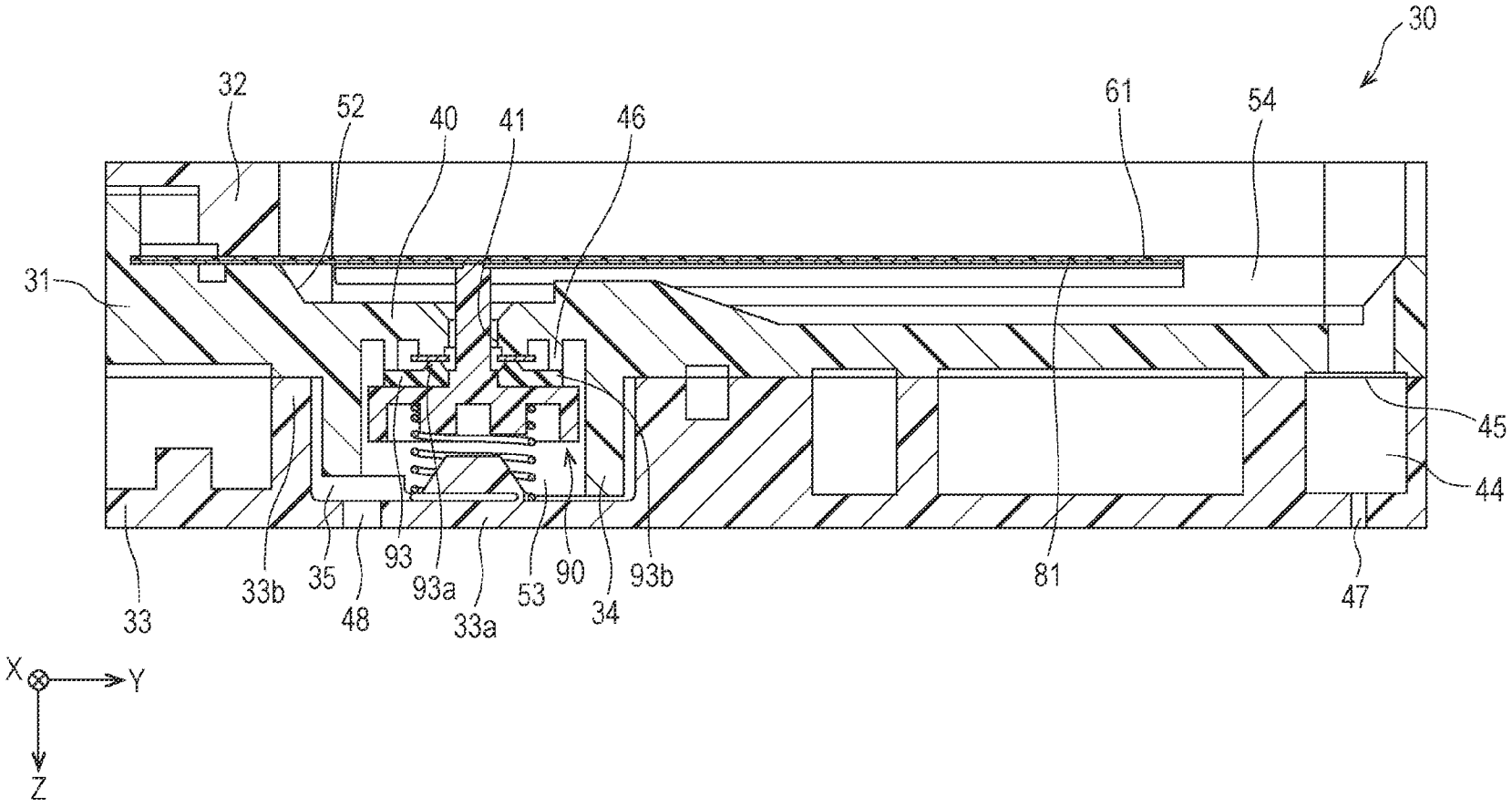
FIG. 2 is a cross-sectional view of a pressure adjustment unit according to the first embodiment.
Figure 3:
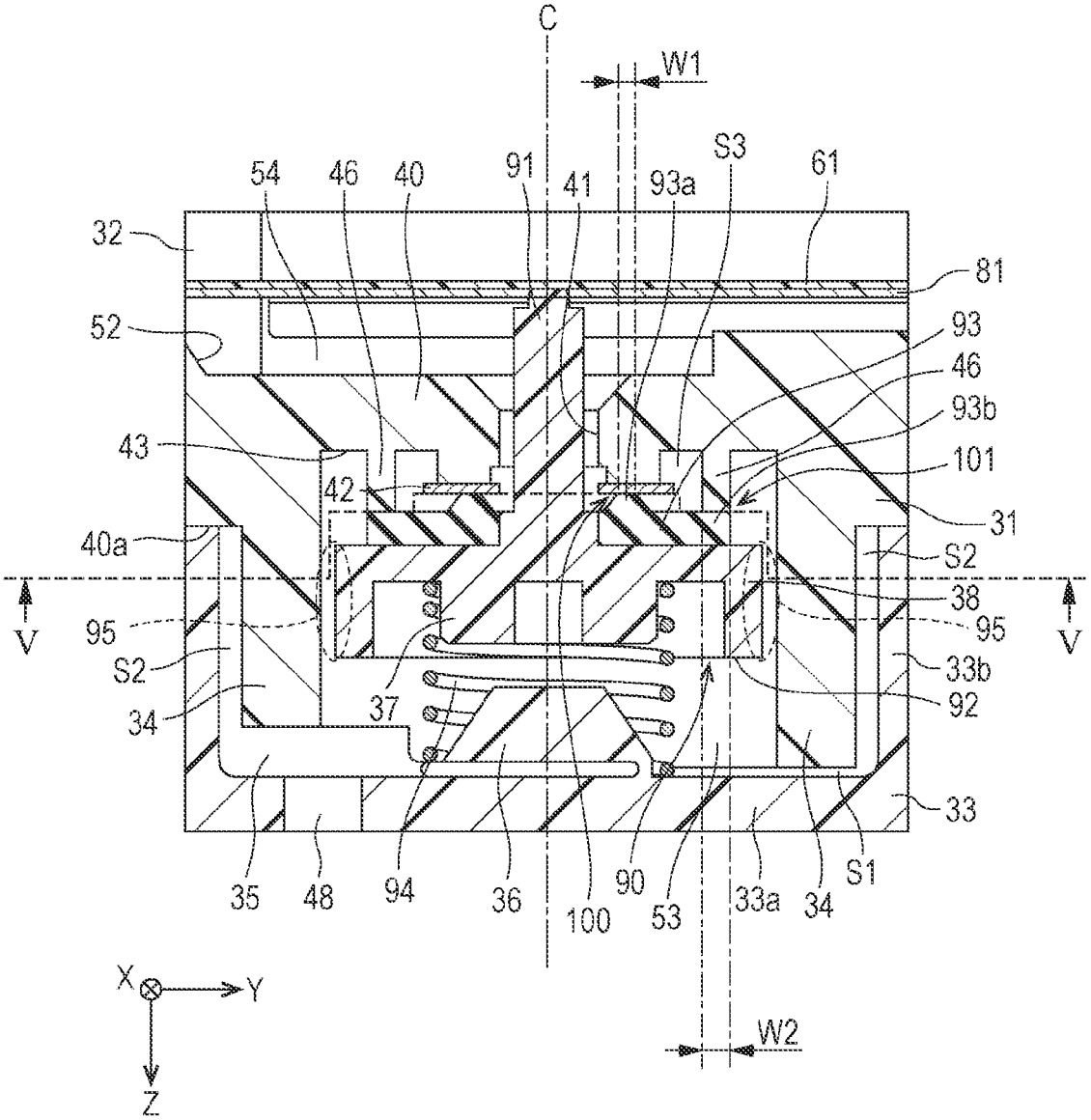
FIG. 3 is an enlarged cross-sectional view of an essential part of the pressure adjustment unit according to the first embodiment.
Figure 4:
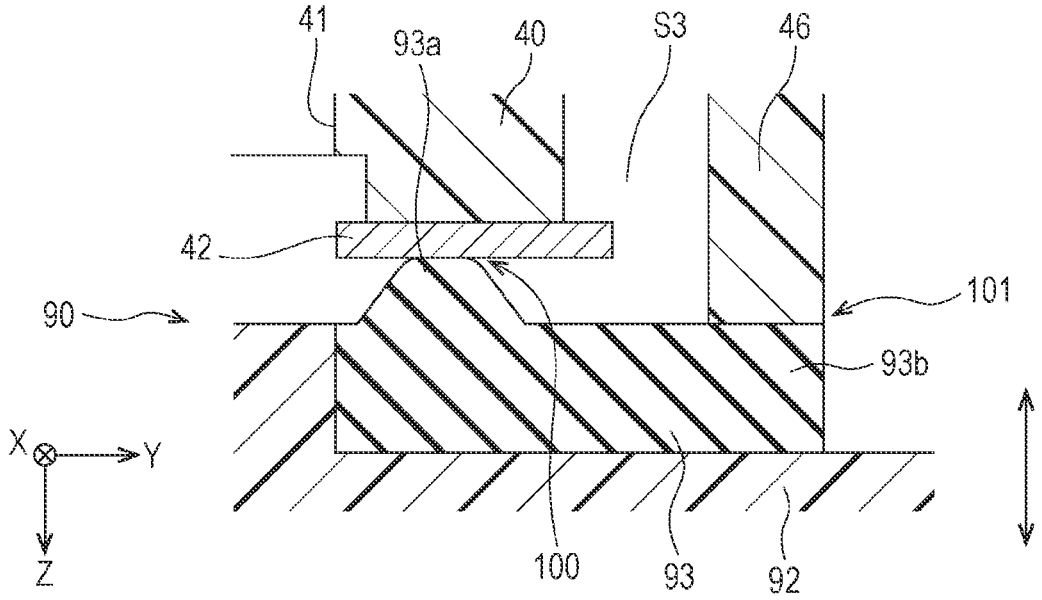
FIG. 4 is a cross-sectional view of the neighborhood of a first portion and a second portion according to the first embodiment.
Figure 5:
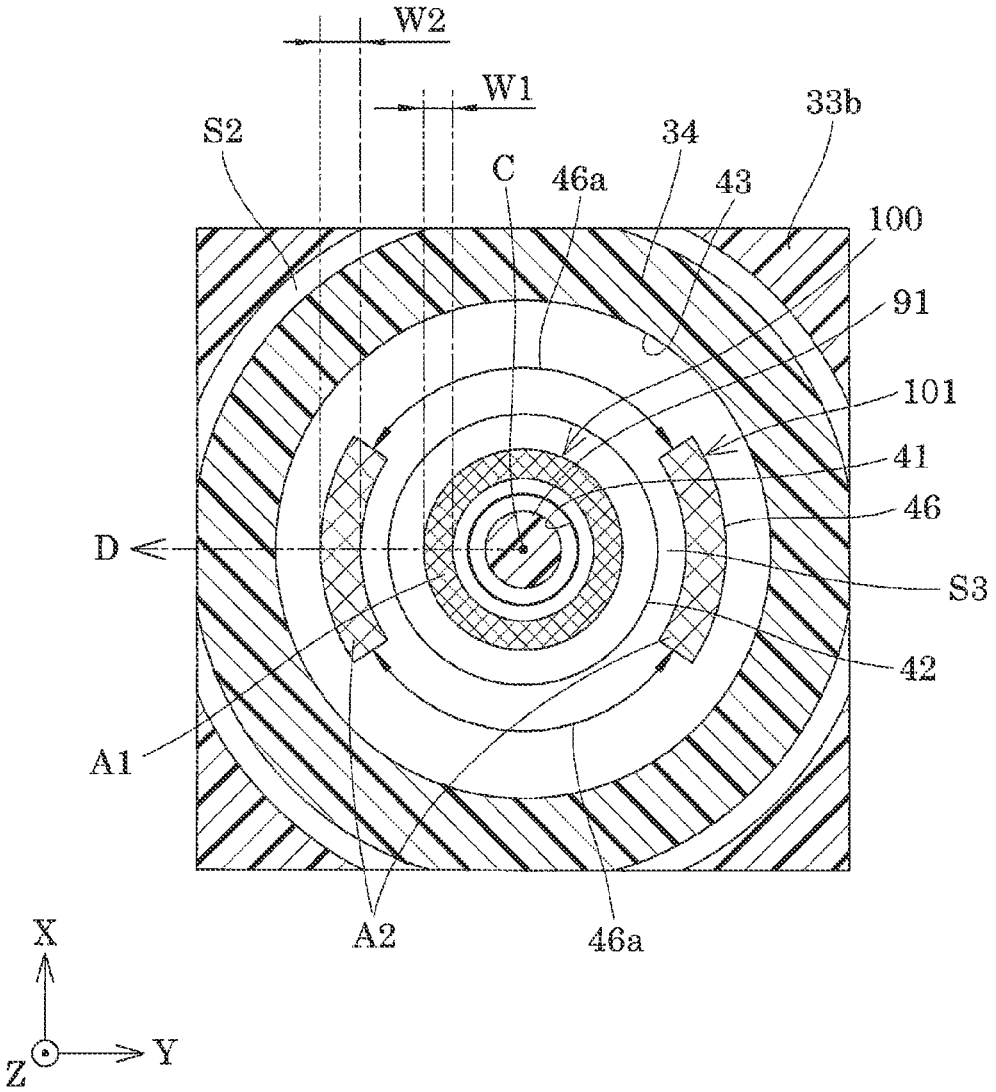
FIG. 5 is a cross-sectional view taken along the line V-V of FIG. 3.
Figure 6:
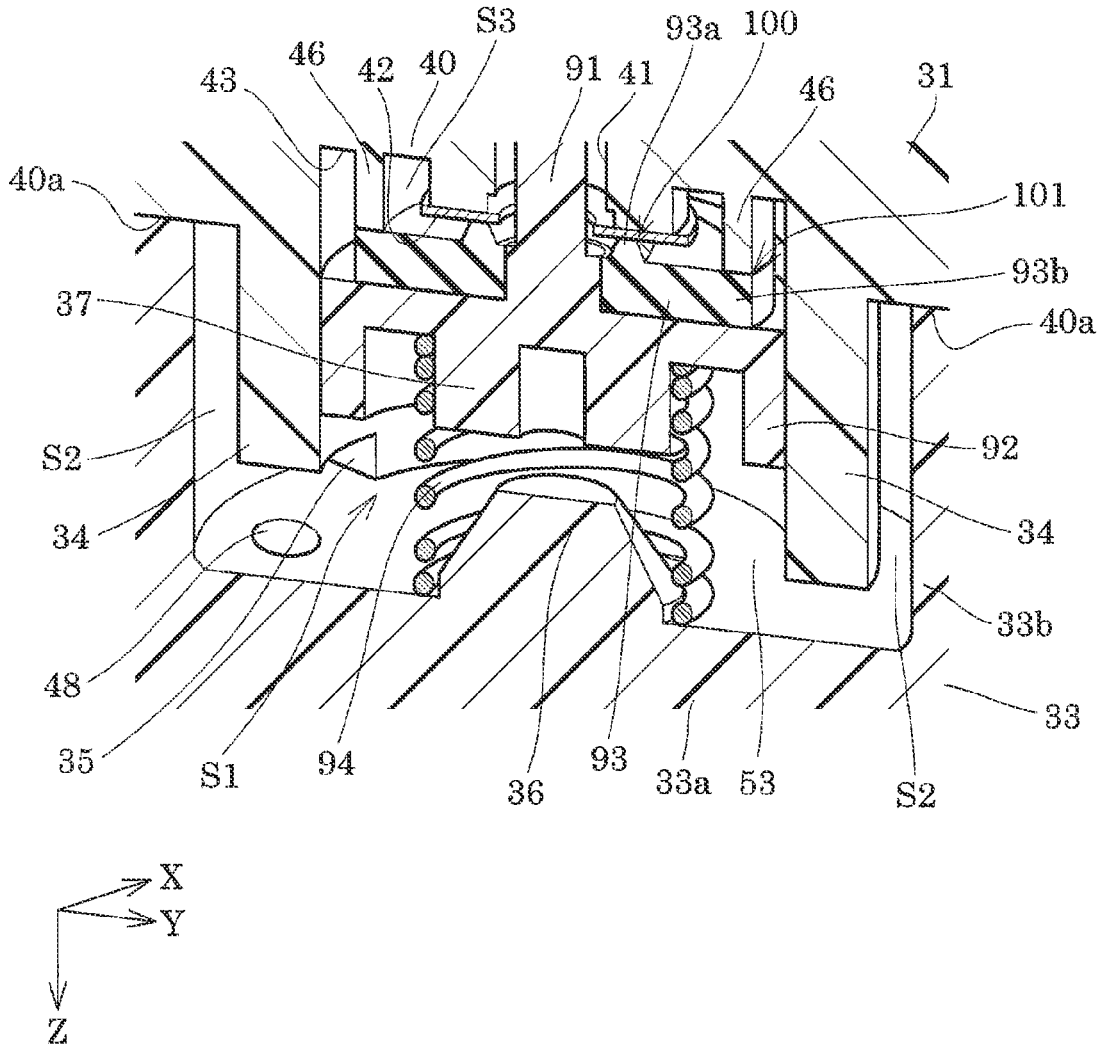
FIG. 6 is a perspective view of the neighborhood of a first chamber according to the first embodiment.
Figure 7:
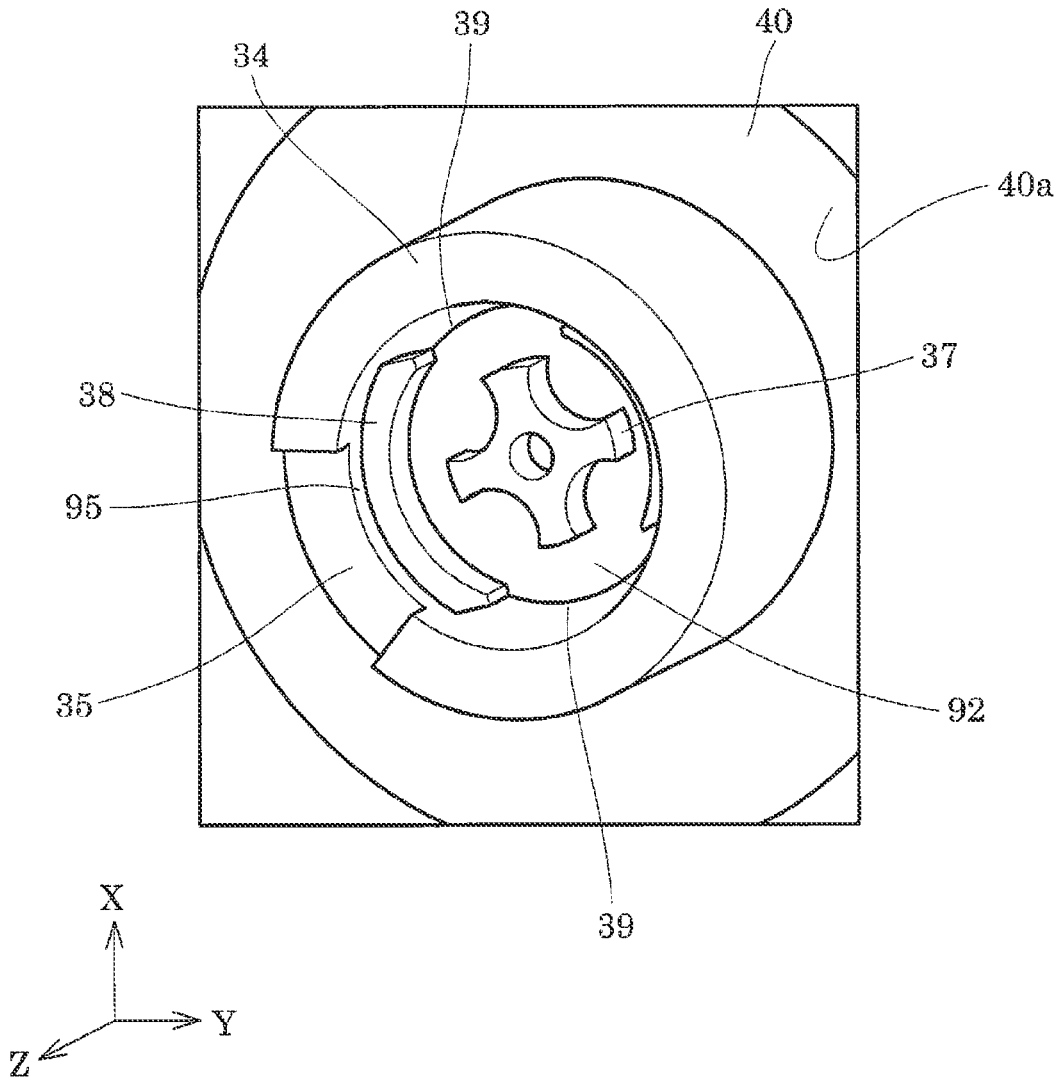
FIG. 7 is a perspective view of the neighborhood of the base-end portion of a valve according to the first embodiment.
Figure 8:
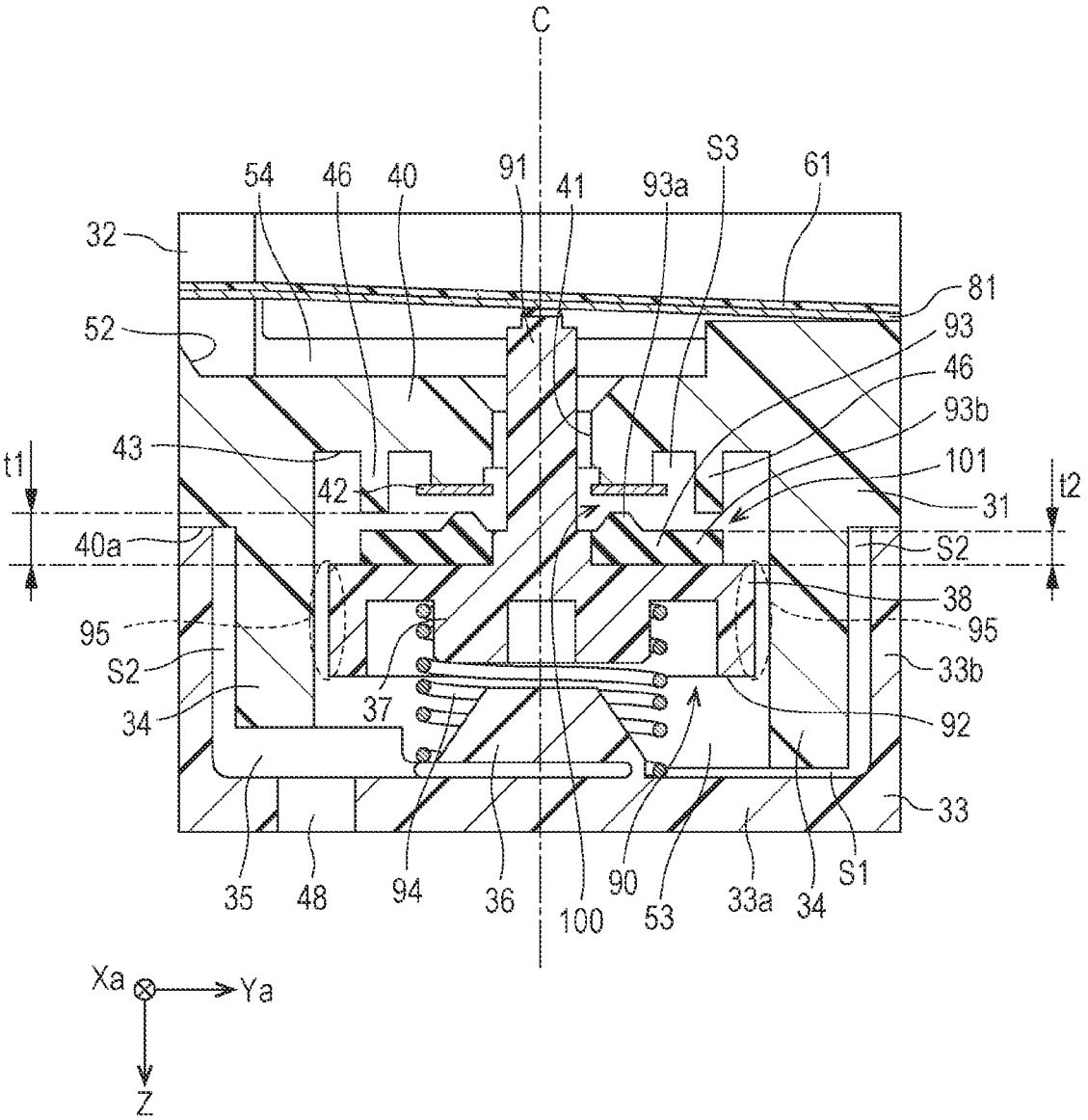
FIG. 8 is a cross-sectional view for explained a valve-opened state of the pressure adjustment unit according to the first embodiment.

With reference to FIGS. 2 to 8, the pressure adjustment unit 30 according to the present embodiment will now be explained. FIG. 2 is a cross-sectional view of the pressure adjustment unit 30 in a valve-closed state. FIG. 3 is an enlarged view of the neighborhood of a first chamber 53 in FIG. 2. FIG. 4 is an enlarged view of the neighborhood of a first portion 100 and a second portion 101 in FIG. 3. FIG. 5 is a cross-sectional view taken along the line V-V of FIG. 3. FIG. 6 is a perspective view of the neighborhood of the first chamber 53. FIG. 7 is a perspective view of the neighborhood of a base-end portion 92 of a valve 90. FIG. 8 is a cross-sectional view of the pressure adjustment unit 30 in a valve-opened state.

As illustrated in FIG. 2, the pressure adjustment unit 30 has a casing 31, a cover member 32, a sealing member 33, a valve 90, a first chamber 53, and a second chamber 54. The cover member 32 is disposed on the −Z directional side with respect to the casing 31. The sealing member 33 is disposed on the +Z directional side with respect to the casing 31. The casing 31, the cover member 32, and the sealing member 33 are made of, for example, resin. The first chamber 53 and the second chamber 54 constitute a part of a flow passage through which ink is supplied to the nozzles 28. The first chamber 53 and the second chamber 54 are located in this order in the −Z direction.

The casing 31 has a partition wall 40 and a first wall portion 34. The partition wall 40 separates the first chamber 53 and the second chamber 54 from each other. The first wall portion 34 has an annular shape and extends from the partition wall 40 in the +Z direction in such a way as to form the first chamber 53. In the present embodiment, the shape of the +Z-side end of the first wall portion 34 is a flat plane perpendicular to the +Z direction, except for its part where a grooved portion 35 is formed. The grooved portion 35 will be described later.

The sealing member 33 is disposed on the +Z-directional side with respect to the casing 31. In the present embodiment, the sealing member 33 has a sealing portion 33*a*, which faces the partition wall 40 to form the first chamber 53 therebetween, and a second wall portion 33*b*, which extends from the sealing portion 33*a* in the −Z direction in such a way as to surround the outer circumference of the first wall portion 34. In other words, the sealing member 33 has the second wall portion 33*b* forming a cylindrical cavity in such a way as to cover the outer circumference of the first wall portion 34. That is, the sealing portion 33*a* defines the bottom surface of the cavity encompassing the outer circumference of the first wall portion 34, and the second wall portion 33*b* defines the side surface of this cavity. The first chamber 53, in which the valve 90 is housed, is formed by covering the first wall portion 34 by the sealing member 33. The first chamber 53 may be called as "valve housing chamber". The sealing member 33 has an inlet 48, through which ink flows into the first chamber 53. As illustrated in FIG. 3, the first wall portion 34 is spaced from the sealing portion 33*a*. Namely, the +Z-side end face of the first wall portion 34 and the −Z-side surface of the sealing portion 33*a*, which face each other, are not in contact with each other, meaning that there is a clearance S1 therebetween. The clearance S1 includes the grooved portion 35 provided in the first wall portion 34. A more detailed description of it will be given later.

There is a gap S2 between the outer circumferential surface of the first wall portion 34 and the inner circumferential surface of the second wall portion 33*b*. That is, the outer circumferential surface of the first wall portion 34 and the inner circumferential surface of the second wall portion 33*b* are not in contact with each other. Namely, when viewed in the +Z direction, the inner diameter of the second wall portion 33*b* is slightly larger than the outer diameter of the first wall portion 34, and there is the gap S2 formed by the difference between the inner diameter of the second wall portion 33*b* and the outer diameter of the first wall portion 34. Providing the gap S2 between the first wall portion 34 and the second wall portion 33*b* makes it easier to insert the first wall portion 34 into the space inside the second wall portion 33*b* and thus makes assembly easier. To fill the gap S2 between the first wall portion 34 and the second wall portion 33*b* with an adhesive or the like, a structure for putting the adhesive in is needed, resulting in a need for a structure change. In addition, the adhesive that is present in the gap S2 might behave as a foreign object and cause a poor valve-closed state due to poor sealing between the valve 90 and a valve seat 42, or the foreign object might flow out to the recording head 19, resulting in poor ink ejection. In the present embodiment, the gap S2 is not filled with an adhesive, etc. This makes a structure for putting the adhesive in unnecessary and thus makes a structure change unnecessary. In addition, since the adhesive is absent in the gap S2, it is possible to prevent the adhesive from behaving as a foreign object and causing a poor valve-closed state due to poor sealing between the valve 90 and the valve seat 42, and prevent poor ink droplet ejection.

The first chamber 53 is spatially defined by fixing the −Z-side end of the second wall portion 33*b* to a fixation surface 40*a*, which is the +Z-side surface of the partition wall 40 outside the first wall portion 34. That is, the partition wall 40 has the fixation surface 40*a* fixed to the −Z-side end of the second wall portion 33*b*. The fixation surface 40*a* according to the present embodiment is a flat surface provided along the X-Y plane, which is defined by the X axis and the Y axis, outside the first wall portion 34. The fixation surface 40*a* extends up to the region forming the gap S2. Therefore, the −Z-side end of the gap S2 is defined by the fixation surface 40*a*. The fixation surface 40*a* is located on the +Z-directional side with respect to the +Z-side opening face of a through hole 41 of the partition wall 40. The method of fixing the fixation surface 40*a* to the second wall portion 33*b* is not specifically limited. However, it will be preferable if an adhesive is used for bonding the fixation surface 40*a* and the second wall portion 33*b* to each other. That is, it will be preferable if an adhesive is used for bonding the casing 31 and the sealing member 33 to each other. Using an adhesive for the bonding of the casing 31 and the sealing member 33 makes it possible to fix them to each other and prevent the leakage of ink from a flow passage provided between the casing 31 and the sealing member 33 without any need for using a sealing member such as rubber for prevent the leakage of the ink from the flow passage provided between the casing 31 and the sealing member 33. Moreover, since the fixation surface 40*a*, to which the second wall portion 33*b* is fixed, is provided outside the first wall portion 34, when the fixation surface 40*a* and the second wall portion 33*b* are bonded to each other, it is possible to prevent, by the first wall portion 34, excess adhesive from moving into the through hole 41, which is formed through the partition wall 40 for communication between the first chamber 53 and the second chamber 54. Therefore, it is possible to prevent an increase in flow-passage resistance due to the clogging of the through hole 41 by the adhesive, and prevent the adhesive from adhering to the valve seat 42, which will be described in detail later, to cause poor sealing between the valve 90 and the valve seat 42, resulting in a poor valve-closed state. The presence of the clearance S1 between the first wall portion 34 and the sealing portion 33*a* ensures good bonding of the second wall portion 33*b* and the fixation surface 40*a* of the partition wall 40. If the first wall portion 34 is in contact with the sealing portion 33*a*, there is a risk that a gap might be formed between the second wall portion 33*b* and the fixation surface 40*a* due to a manufacturing error of the first wall portion 34 or the sealing portion 33*a*, or there may be variation in the gap; therefore, there is a possibility of poor bonding. Moreover, there is a risk of ink leakage due to poor bonding from any other flow passage provided between the casing 31 and the sealing member 33, for example, from a filter chamber 44, etc., which will be described in detail later. Since the first wall portion 34 has such a length that the first wall portion 34 is not in contact with the sealing portion 33*a*, that is, since there is the clearance S1 therebetween, even if there is a manufacturing error, it is possible to bond the second wall portion 33*b* and the fixation surface 40*a* to each other reliably and thus prevent the leakage of ink from the flow passage. It is sufficient as long as the inner circumferential surface of the first wall portion 34 has an annular shape. The first wall portion 34 itself does not necessarily have to have an annular shape. The term "annular" as used herein is not limited to the meaning of continuous annularity. There may be a non-continuous part due to the presence of a slit, a groove, a recess, a through hole, or the like. In the present embodiment, as will be described in detail later, the first wall portion 34 has the grooved portion 35 that is open in the +Z direction.

There is a recessed opening 52 in the −Z-side surface of the casing 31. A flexible film 61 made of resin is disposed in such a way as to cover the opening 52. The film 61, together with the cover member 32, is fixed by being bonded to the casing 31. Since the film 61 is disposed in such a way as to cover the opening 52, the second chamber 54 is formed between the casing 31 and the film 61. The second chamber 54 may be called as "pressure chamber". The opposite side of the film 61, which is the opposite of the side oriented toward the second chamber 54, is exposed to air.

A pressure receiving member 81 is disposed on, of the film 61, the side oriented toward the second chamber 54. The pressure receiving member 81 is made of a material having a greater rigidity than the film 61, for example, a thin SUS plate, etc. One end of the pressure receiving member 81 is supported at the bonded portion of the casing 31 and the cover member 32. When the film 61 deforms in the +Z direction, the pressure receiving member 81 also becomes displaced in the +Z direction. The film 61 and the pressure receiving member 81 may be bonded to each other or not bonded to each other.

The filter chamber 44 defined by a cavity formed in the sealing member 33 is provided on the +Z-directional side with respect to the +Y-side end of the second chamber 54. The filter chamber 44 and the second chamber 54 are in communication with each other via a filter 45. The filter 45 is fixed between the sealing member 33 and the casing 31 by bonding them to each other. A foreign object, etc. contained in ink that flows from the second chamber 54 into the filter chamber 44 is removed by the filter 45. The filter 45 is made of, for example, metal mesh, non-woven fabric, or the like. There is an outlet 47 in the +Z-side bottom of the filter chamber 44. The ink from which the foreign object, etc. has been removed by the filter 45 flows out to the recording head 19 through the outlet 47. Although the pressure adjustment unit 30 is equipped with the filter 45 in the present embodiment, the pressure adjustment unit 30 may be not equipped with the filter 45.

As illustrated in FIG. 3, the through hole 41, which extends in the −Z direction from the first chamber 53 toward the second chamber 54 for providing communication between the first chamber 53 and the second chamber 54, is formed in the partition wall 40.

The valve 90 has a base-end portion 92, which is housed in the first chamber 53, a columnar axial portion 91, which protrudes from the base-end portion 92 in the −Z direction, and an elastic member 93, which is provided on the upper surface of the base-end portion 92. In the present embodiment, the base-end portion 92 and the axial portion 91 are made of resin such as polypropylene, poly p-phenylenebenzobisoxazole, or the like. The elastic member 93 is made of a flexible elastic material, for example, elastomer such as silicone rubber, urethane rubber, fluorine-containing rubber, or the like. In the present embodiment, the elastic member 93 corresponds to "a first sealing portion".

The base-end portion 92 according to the present embodiment has a substantially disc-like shape. The outer diameter of the base-end portion 92 in a cross section perpendicular to the +Z direction is larger than the outer diameter of the axial portion 91 in the cross section perpendicular to the +Z direction. The base-end portion 92 may be called as "flange portion". The axial portion 91 is inserted into the through hole 41 formed in the partition wall 40. The tip of the axial portion 91 is in contact with the pressure receiving member 81 disposed in the second chamber 54.

A coil spring 94, which is an example of "a biasing member" and biases the valve 90 in the −Z direction, is provided between the sealing member 33 and the base-end portion 92 in the first chamber 53. The coil spring 94 is called also as an urging member and urges the valve 90 in the −Z direction. The +Z-side end of the coil spring 94 is positioned by a truncated-cone-shaped first convex portion 36 formed on the −Z-side surface of the sealing portion 33*a*. The −Z-side end of the coil spring 94 is fitted on a second convex portion 37 formed on the +Z-side surface of the base-end portion 92 of the valve 90. The "biasing member" is not limited to the coil spring 94. For example, a leaf spring or a disc spring may be used instead. The valve 90 is pushed in the −Z direction due to the urging force of the coil spring 94 (in other words, spring load) and the supply pressure of ink supplied into the first chamber 53 from the inlet 48.

As illustrated in FIG. 7, in the present embodiment, the second convex portion 37, on which the −Z-side end of the coil spring 94 is fitted, has a substantially cross shape. The base-end portion 92 has a sliding contact portion 38 on its outer circumferential part. The sliding contact portion 38 is in contact with, and is able to slide on, the inner circumferential surface of the first wall portion 34. The sliding contact portion 38 protrudes in the +Z direction from the +Z-side surface of the base-end portion 92. In the present embodiment, the sliding contact portion 38 is provided at two positions that are the opposite of each other, with the second convex portion 37 located therebetween. The region where the sliding contact portion 38 is not provided, of the base-end portion 92, forms a gap 39 with respect to the first wall portion 34. In the present embodiment, the gap 39 is provided at two positions, with the second convex portion 37 located therebetween. Ink that has flowed into the first chamber 53 from the inlet 48 flows through these gaps 39 to go from the first chamber 53 toward the through hole 41. The number of the sliding contact portions 38 and the number of the gaps 39 may be set arbitrarily; the number may be just one, or three or more. It is sufficient as long as there is a possibility that the sliding contact portion 38 could come into sliding contact with the first wall portion 34. The sliding contact portion 38 may be not always in sliding contact with the first wall portion 34. For example, the plurality of the sliding contact portions 38 may include a sliding contact portion 38 that is not actually in sliding contact with the first wall portion 34. A positioning area 95 for positioning the direction of the valve 90 perpendicular to the Z axis and the direction of the valve 90 inclined with respect to the Z axis is provided on the periphery of the base-end portion 92. In the present embodiment, the positioning area 95 is the area between the sliding contact portion 38 and the first wall portion 34.

As illustrated in FIGS. 3 and 7, the grooved portion 35, which is recessed in the −Z direction, is provided in a part of the first wall portion 34, more specifically, in a part of the +Z-side end of the first wall portion 34. The grooved portion 35 goes through the first wall portion 34 in the thickness direction of the first wall portion 34 and is in communication with the first chamber 53. The thickness direction of the first wall portion 34 mentioned here means, for example, a radial direction going away from, or coming closer to, the center of the axial portion 91 of the valve 90 as viewed along the Z axis. The grooved portion 35 is provided in the first wall portion 34 at the part where the inlet 48 formed in the sealing member 33 opens to the first chamber 53. That is, the inlet 48 and the grooved portion 35 have an overlapping range as viewed in the +Z direction. Ink that has flowed in from the inlet 48 flows into the first chamber 53 via the grooved portion 35. In the present embodiment, the grooved portion 35 is provided in the first wall portion 34 at one position only. However, the grooved portion 35 may be provided in the first wall portion 34 at a plurality of positions.

As illustrated in FIGS. 3 and 4, the elastic member 93 is provided inside the outer circumference of the base-end portion 92 and outside the axial portion 91 as viewed in the +Z direction. The elastic member 93 has, at its part that comes into contact with the valve seat 42, a protrusion 93*a* protruding in the −Z direction. The protrusion 93*a* is provided such that it has a continuous annular shape surrounding the axial portion 91. The protrusion 93*a* has a substantially triangular cross-sectional shape such that it tapers toward its −Z-side apex. The −Z-side apex of the protrusion 93*a* of the elastic member 93 comes into contact with the valve seat 42 and then deforms elastically. As a result, the elastic member 93 comes into tight contact with the valve seat 42, and the through hole 41 becomes closed, thereby putting the first chamber 53 and the second chamber 54 into a non-communication state, that is, a valve-closed state. In the present embodiment, the elastic member 93 corresponds to "a first sealing portion", and the valve seat 42 corresponds to "a second sealing portion". The portion where the protrusion 93*a* of the elastic member 93 comes into contact with the valve seat 42 to close the through hole 41 will be referred to as a first portion 100. The elastic member 93 according to the present embodiment is provided only on the −Z-side surface of the base-end portion 92. The elastic member 93 is not provided on, of the side surface of the axial portion 91, the portion that is inserted into the through hole 41. The elastic member 93 is not provided on the outer circumferential surface of the base-end portion 92.

The elastic member 93 has a contact portion 93*b* outside the protrusion 93*a*. The contact portion 93*b* is provided continuously in the circumferential direction outside the protrusion 93*a*. The contact portion 93*b* has a substantially uniform thickness throughout its entirety in the circumferential direction. Therefore, the −Z-side surface of the contact portion 93*b* is a flat plane perpendicular to the Z axis. The contact portion 93*b* comes into contact with a first rib 46, a detailed explanation of which will be given later, thereby restricting the movement of the valve 90 in the −Z direction. The first rib 46 is an example of "a restricting portion". The contact portion 93*b* is an example of "a to-be-restricted portion". The thickness of the elastic member 93 at the protrusion 93*a* along the Z axis is greater than the thickness of the elastic member 93 at the contact portion 93*b* along the Z axis. The thickness of the elastic member 93 at the protrusion 93*a* along the Z axis means its thickness t1, and the thickness of the elastic member 93 at the contact portion 93*b* along the Z axis means its thickness t2, in a state in which, as illustrated in FIG. 8, the protrusion 93*a* is not in contact with the valve seat 42, and the contact portion 93*b* is not in contact with the first rib 46. A more detailed explanation of this state will be given later. That is, the thickness t1 at the protrusion 93*a* is greater than the thickness t2 at the contact portion 93*b* (t1>t2). Since the thickness t1 at the protrusion 93*a* is greater than the thickness t2 at the contact portion 93*b*, it is possible to make sealing easier with the tight contact of the protrusion 93*a* with the valve seat 42 at the first portion 100 due to a larger amount of deformation of the protrusion 93*a* of the elastic member 93 at the first portion 100 than the amount of deformation of the contact portion 93*b*.

As illustrated in FIGS. 3 and 4, on the +Z-side surface of the partition wall 40, that is, on its surface closer to the first chamber 53, the valve seat 42 having an annular shape is provided around the through hole 41. The protrusion 93*a* of the elastic member 93 provided as a constituent of the valve 90 comes into contact with the valve seat 42; by this contact, the valve seat 42 serves as the second sealing portion for closing the through hole 41. In the present embodiment, the valve seat 42 is a discrete member that is not an integral part of the partition wall 40. The valve seat 42 is made of metal. For example, stainless steel (SUS) or titanium can be used as the metal. A liquid-repellent treatment such as fluorine coating may be applied to the +Z-side surface of the valve seat 42, with which the elastic member 93 comes into contact. The valve seat 42 is fixed to the partition wall 40 by means of an adhesive. The valve seat 42 is disposed on the −Z-directional side with respect to the fixation surface 40*a*. The material of the valve seat 42 is not limited to metal. The valve seat 42 may be made of resin, ceramic, or the like. A flexible elastic material that is the same as or similar to that of the elastic member 93, for example, elastomer such as silicone rubber, urethane rubber, fluorine-containing rubber, or the like, may be used as the material of the valve seat 42. For example, when the same elastomer material as that of the elastic member 93 is used for the valve seat 42, it is possible to provide secure sealing between the protrusion 93*a* and the valve seat 42 and thus secure valve closure by making the valve seat 42 thinner than the protrusion 93*a* of the elastic member 93 to make its amount of elastic deformation smaller.

In the present embodiment, as viewed in the +Z direction, outside the portion where the valve seat 42 is provided, the partition wall 40 has an annular concave portion 43 that is recessed in the −Z direction with respect to the portion where the valve seat 42 is provided. The concave portion 43 has a function of accommodating excess adhesive squeezed out of the gap between the valve seat 42 and the partition wall 40 when the valve seat 42 is bonded to the partition wall 40. The concave portion 43 is recessed in the −Z direction with respect to the fixation surface 40*a* to which the second wall portion 33*b* is fixed. Therefore, the concave portion 43 has a function of accommodating excess adhesive squeezed out of the gap between the second wall portion 33*b* and the fixation surface 40*a* when the second wall portion 33*b* is bonded to the fixation surface 40*a*.

The first rib 46 protruding in the +Z direction is provided on the partition wall 40. The protruding of the first rib 46 from the partition wall 40 in the +Z direction means that the first rib 46 protrudes in the +Z direction in a state in which the base end of the first rib 46 is fixed to the partition wall 40. In the present embodiment, the first rib 46 protrudes in the +Z direction from the −Z-side bottom surface of the concave portion 43 outside the valve seat 42. As the first rib 46, plural ribs are provided at intervals in the circumferential direction of the valve seat 42. In the present embodiment, two first ribs 46 are provided at symmetric positions with respect to the center C of the valve 90. The first rib 46 is provided around the valve seat 42 in the circumferential direction; this means that the first rib 46 is provided along a virtual circle whose center lies at the center C of the valve 90. In other words, the first rib 46 is provided annularly outside the valve seat 42 in such a way as to partially surround the valve seat 42, and has a shape of being split by a slit provided along the Z axis. In the present embodiment, the interval between the plurality of first ribs 46, that is, the slit gap, is referred to as a communication path 46*a*. In the present embodiment, two communication paths 46*a* are provided between two first ribs 46. The two communication paths 46*a* are located at symmetric positions with respect to the center C of the valve 90.

The first rib 46 is located at a position where its end surface faces with the contact portion 93*b* of the elastic member 93 with respect to the Z axis. That is, the contact portion 93*b* of the elastic member 93 is located at a position where it faces with the concave portion 43 with respect to the Z axis, and the first rib 46 protrudes in the +Z direction from the bottom surface of the concave portion 43 toward the contact portion 93*b*. The first rib 46 according to the present embodiment is located with some clearance from the valve seat 42 in the radial direction going away from, or coming closer to, the center of the axial portion 91 of the valve 90 as viewed along the Z axis. In the present embodiment, the first rib 46 described above is made of the same material as that of the partition wall 40 and is provided as an integral part of the partition wall 40. For example, the partition wall 40 and the first rib 46 are formed at the same time in the process of molding the casing 31. That is, the first rib 46 according to the present embodiment is made of a rigid material. The term "rigid material" means on object that does not deform under stress within a range of ordinary use as the pressure adjustment unit 30, that is, under the action of the sum of the supply pressure of ink and the spring load of the coil spring 94, which is an example of a biasing member. Examples of such a rigid material are: resin, metal such as stainless steel (SU) or the like, ceramic, and the like. Of course, the material of the partition wall 40 and the material of the first rib 46 may be different from each other, and they may be bonded together. The material of the first rib 46 is not limited to a rigid material. The first rib 46 may be made of a flexible elastic material such as elastomer or the like. The shape of the +Z-side end of the first rib 46 is a flat plane perpendicular to the +Z direction.

When the valve 90 moves in the −Z direction to close the through hole 41 at the first portion 100 for valve closure, the first rib 46 described above restricts the movement of the valve 90 in the −Z direction by contact with the contact portion 93*b* of the elastic member 93. That is, the first rib 46 corresponds to "a restricting portion" that restricts the movement of the valve 90 in the −Z direction, and the contact portion 93*b* of the elastic member 93 corresponds to "a to-be-restricted portion" which comes into contact with the first rib 46, "a restricting portion". The contact portion 93*b*, "a to-be-restricted portion" according to the present embodiment, is made of elastomer. The portion where the contact portion 93*b* of the elastic member 93 comes into contact with the first rib 46 will be referred to as a second portion 101. In the present embodiment, a part of the elastic member 93, which is an example of "a first sealing portion", is the contact portion 93*b* constituting the second portion 101. That is, the elastic member 93 has the protrusion 93*a* configured to come into contact with the valve seat 42, and a part of the elastic member 93 is configured as the contact portion 93*b*, which is an example of "a to-be-restricted portion" configured to come into contact with the first rib 46". With this structure, it is possible to use the same one member, namely, the elastic member 93, both as "a first sealing portion" and as "a to-be-restricted portion". Therefore, it is possible to reduce the number of parts and thus reduce cost. Of course, the elastic member 93, which is an example of "a first sealing portion", and the contact portion 93*b*, which is an example of "a to-be-restricted portion", may be configured as discrete non-common members.

In the present embodiment, the communication paths 46*a* are provided between the first ribs 46. Because of this structure, in a state in which the protrusion 93*a* of the elastic member 93 is in contact with the valve seat 42 at the first portion 100 and in which the contact portion 93*b* of the elastic member 93 is in contact with the first rib 46 at the second portion 101, a space S3 between the first portion 100 and the second portion 101 is in communication with a space outside the first rib 46 via the communication path 46*a*, that is, in communication with the inlet 48.

The opening/closing operation of the valve 90 having the structure described above will now be explained. In the description below, it is assumed that the first chamber 53 and the second chamber 54 are filled with ink either due to initial filling of ink to the nozzles 28 or due to previous ink ejection. As illustrated in FIG. 3, the coil spring 94 always urges the valve 90 in the −Z direction, which is a valve-closing direction. When the valve 90 is closed, the elastic member 93 is in contact with the valve seat 42, and the through hole 41 is closed. That is, in this state, the first chamber 53 and the second chamber 54 are not in communication with each other.

When ink is ejected from the recording head 19 while the first chamber 53 and the second chamber 54 are in a non-communication state, the amount of ink present in the second chamber 54 decreases. Because of the decrease in the amount of ink present in the second chamber 54, as illustrated in FIG. 8, the internal pressure of the second chamber 54 becomes negative due to the difference from atmospheric pressure. Therefore, the film 61 and the pressure receiving member 81 become displaced in such a way as to deform toward the second chamber 54. As a result, the pressure receiving member 81 pushes the end of the axial portion 91 in the +Z direction. Therefore, the valve 90 is pushed down toward the first chamber 53.

When the valve 90 is pushed down against the urging force of the coil spring 94 (in other words, spring load) and the supply pressure of ink supplied from the inlet 48, the elastic member 93 goes away from the valve seat 42, and the valve 90 becomes open. When the valve 90 is open, the through hole 41 is open, that is, in this state, the first chamber 53 and the second chamber 54 are in communication with each other.

When the valve 90 is open, ink present in the first chamber 53 flows into the second chamber 54 through the through hole 41. Then, when the second chamber 54 becomes refilled with ink sufficiently, the negative pressure inside the second chamber 54 returns to non-negative status, the pressure receiving member 81 and the film 61 move in the −Z direction back to the original position, and, due to the urging force of the coil spring 94, the valve 90 becomes closed as illustrated in FIG. 3. In this way, by the opening/closing operation of the valve 90, the second chamber 54 is always adjusted to have a substantially constant pressure level. In the process of switching from a valve-opened state to a valve-closed state, as illustrated in FIGS. 3 and 4, the first rib 46, which is an example of "a restricting portion", restricts the movement of the valve 90 in the −Z direction, by contact with the contact portion 93*b*, which is an example of "a to-be-restricted portion". Therefore, the protrusion 93*a* of the elastic member 93 does not collapse excessively due to the urging of the valve 90 in the −Z direction by the urging force of the coil spring 94 and the supply pressure of ink supplied from the inlet 48, and it is possible to suppress the occurrence of so-called creep, which is a phenomenon of deformation increasing its degree in accordance with the lapse of time under the influence of persistent stress acting on the protrusion 93*a*.

Figure 9:
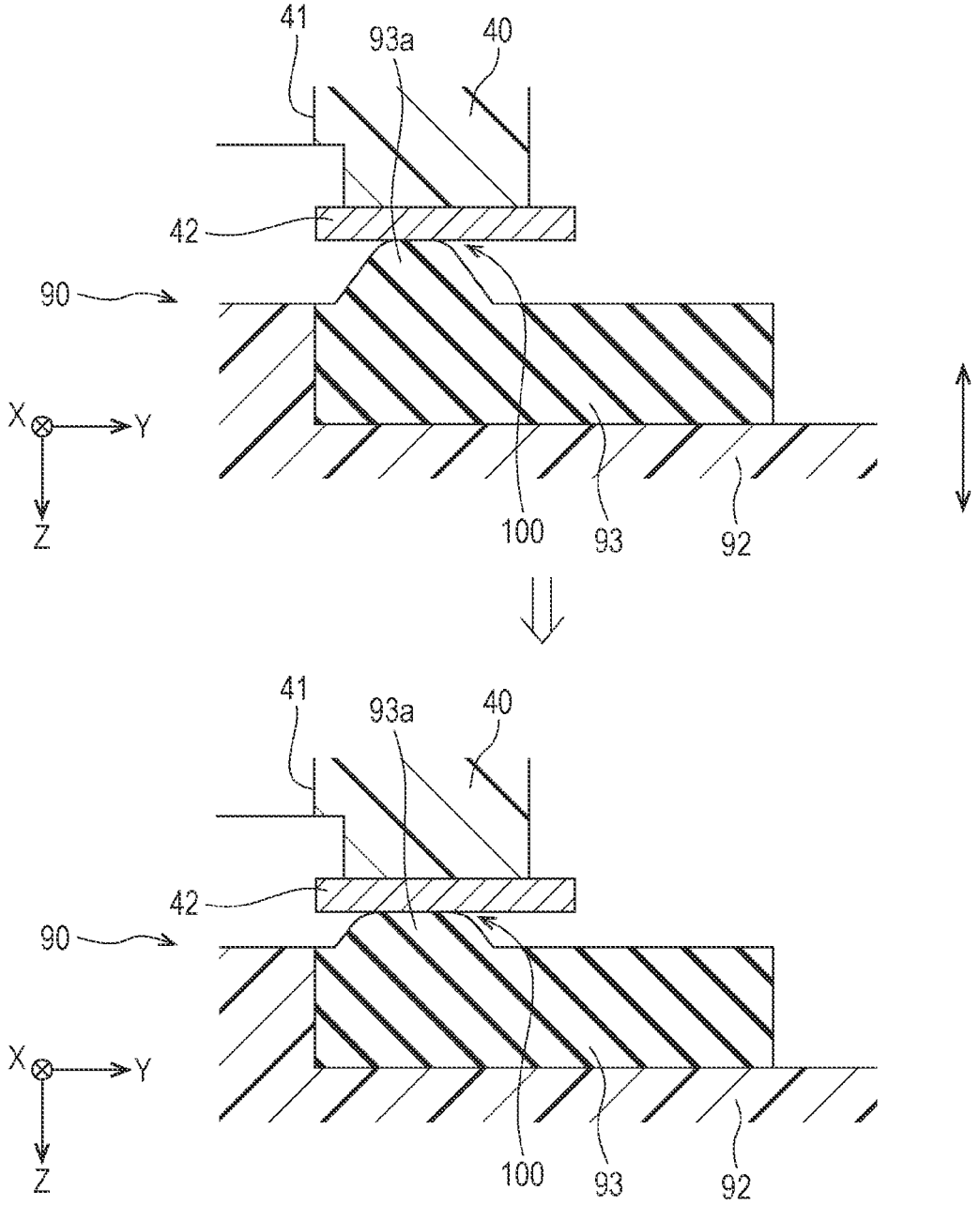
FIG. 9 is a cross-sectional view of the neighborhood of a first portion according to a comparative structure.

If the first rib 46 and the contact portion 93*b* are not provided, as illustrated in FIG. 9, as compared with the shape of the protrusion 93*a* that is in contact with the valve seat 42 in an initial phase, creep deformation will occur due to persistent stress acting on the protrusion 93*a* by the urging force of the coil spring 94 and the supply pressure of ink in accordance with the lapse of time, and, because of the creep deformation, the protrusion 93*a* having been under the influence of persistent stress over time will be more deformed than in the initial phase. If the protrusion 93*a* has become collapsed significantly due to creep deformation, the valve 90 will become closed in a state of being more shifted in the −Z direction than in the initial phase. Therefore, if the protrusion 93*a* is creep-deformed, the closed position of the valve 90 along the Z axis after the lapse of time will vary from the closed position of the valve 90 along the Z axis in the initial phase, and, because of this variation in closed position, the internal pressure of the second chamber 54 will also vary when the film 61 pushes the end of the valve 90 in the +Z direction to open the valve 90. Moreover, if the protrusion 93*a* is creep-deformed, volume downstream of the valve 90 after the opening of the valve 90 after the lapse of time will vary from volume downstream of the valve 90 after the opening of the valve 90 in the initial phase, and, because of this variation in downstream-side volume after the opening, the internal pressure of the second chamber 54 after the closing of the valve 90 will also vary. Since the second chamber 54 in a valve-closed state is in communication with the nozzles 30, if the internal pressure of the second chamber 54 in a valve-closed state varies, the meniscus of the nozzles 28 might be affected, resulting in poor ejection. Furthermore, if the protrusion 93*a* is creep-deformed, the protruding amount of the protrusion 93*a* in the −Z direction will be smaller than in the initial phase, that is, the amount of collapsing will be larger; therefore, the protrusion 93*a* will become harder to deform. For this reason, when a foreign object gets caught between the protrusion 93*a* and the valve seat 42, it will be harder for the protrusion 93*a* to deform along the foreign object; this will decrease a so-called leak limit where ink leakage will occur. Still furthermore, if the protrusion 93*a* is creep-deformed, the hardness of the protrusion 93*a* will increase and, therefore, the push-ability of the protrusion 93*a* onto the valve seat 42 will decrease.

By contrast, in the present embodiment, as illustrated in FIG. 4, the first rib 46, which is an example of "a restricting portion", and the contact portion 93*b*, which is an example of "a to-be-restricted portion", are provided, and the movement of the valve 90 in the −Z direction is restricted by the contact of the first rib 46 and the contact portion 93*b* with each other; therefore, it is possible to prevent stress of predetermined magnitude or greater from being applied to the protrusion 93*a* due to the urging force of the coil spring 94 and the supply pressure of ink as the time elapses, thereby suppressing the creep deformation of the protrusion 93*a*. That is, since the stress applied by the urging force of the coil spring 94 and the supply pressure of ink is split to the first portion 100 and the second portion 101, it is possible to prevent concentrated application of persistent stress to the first portion 100. Therefore, it is less likely that the shape of the protrusion 93*a* after the lapse of time will be different from the shape of the protrusion 93*a* in the initial phase, and the position of the valve 90 along the Z axis after the lapse of time will not easily become shifted from that of the initial phase; therefore, it is possible to prevent variation in the valve-opening pressure and in the internal pressure after the closing of the valve from being caused by such a shift in the position of the valve 90. For this reason, it is possible to perform valve-opening operation and valve-closing operation under constant pressure. Therefore, by making the supply pressure of ink supplied from the pressure adjustment unit 30 to the recording head 19 constant, it is possible to prevent variation in ejection characteristics of ink droplets ejected from the recording head 19, namely, variation in velocity of ejected ink droplets traveling in air, variation in ink droplet weight, and the like, and, in addition, it is possible to prevent poor ejection and thus improve print quality.

Moreover, since the disclosed structure suppresses the occurrence of creep deformation of the protrusion 93*a*, it is possible to prevent variation in the protruding amount of the protrusion 93*a* in the −Z direction, that is, the amount of collapsing, between the state in the initial phase and the state after the lapse of time. Therefore, even after the lapse of time, the protrusion 93*a* will not become harder to deform. When a foreign object gets caught between the protrusion 93*a* and the valve seat 42, it will be easier for the protrusion 93*a* to deform along the foreign object. By this means, it is possible to prevent a decrease in a leak limit. Furthermore, since the disclosed structure suppresses the occurrence of creep deformation of the protrusion 93*a*, it is possible to prevent an increase in the hardness of the protrusion 93*a* and prevent a resultant decrease in the push-ability of the protrusion 93*a* onto the valve seat 42.

In addition, in the present embodiment, the first rib 46 protrudes in the +Z direction from the −Z-side bottom surface of the concave portion 43 such that there is a sufficient clearance between the valve seat 42 and the first rib 46 in the radial direction going away from, or coming closer to, the center of the axial portion 91 of the valve 90 as viewed along the Z axis. Since the first rib 46 is provided in this way, the disclosed structure does not obstruct the function of the concave portion 43 of accommodating excess adhesive squeezed out of the gap between the valve seat 42 and the partition wall 40 when the valve seat 42 is bonded to the partition wall 40. That is, if the first rib 46 is provided adjacent to the valve seat 42 without being spaced therefrom, the first rib 46 will obstruct the flow of excess adhesive into the concave portion 43. Therefore, the excess adhesive might flow into the through hole 41 and cause the clogging of the through hole 41, or the excess adhesive that has flowed into the through hole 41 might cause the tilting of the axial portion 91 of the valve 90, or other problems might occur. Since the first rib 46 protrudes in the +Z direction from the −Z-side bottom surface of the concave portion 43 such that there is a sufficient clearance between the valve seat 42 and the first rib 46 in the radial direction of the axial portion 91, it is possible to prevent the first rib 46 from obstructing the flow of excess adhesive into the concave portion 43. Therefore, it is possible to prevent problems such as the clogging of the through hole 41 with the excess adhesive, prevent the tilting of the axial portion 91 of the valve 90 by the excess adhesive that has flowed into the through hole 41, and the like.

Moreover, since the first rib 46 protrudes from the −Z-side bottom surface of the concave portion 43, it is possible to provide the first rib 46 at an outer-circumference-side position spaced from the valve seat 42. Therefore, even though the second portion 101 is split in the circumferential direction, it is possible to make the pressure-receiving area size of the second portion 101 large.

Moreover, in the present embodiment, since the second portion 101 is located outside the first portion 100, the second portion 101 is located outside the coil spring 94, which is an example of "a biasing member". This arrangement makes the spring load of the coil spring 94 easier to be transmitted to the first portion 100 and harder to be transmitted to the second portion 101. Therefore, it is possible to improve sealing performance at the first portion 100 by making the spring load of the coil spring 94 easier to be transmitted to the first portion 100.

Moreover, in the present embodiment, the first rib 46 is made of a rigid material, and the contact portion 93*b* is made of elastomer, which is a flexible elastic material. By this means, it is possible to prevent the valve 90 from becoming unable to move on the basis of the second portion 101. That is, even if a foreign object gets caught between the first rib 46 and the contact portion 93*b* or even if the valve 90 becomes tilted with respect to the Z axis, since the contact portion 93*b* is deformable, the valve 90 will not become unable to move on the basis of the second portion 101. Moreover, by using a rigid material for either one of the first rib 46, which is an example of "a restricting portion", and the contact portion 93*b*, which is an example of "a to-be-restricted portion", and using elastomer, which is a flexible elastic material, as the material of the other, it is possible to adjust the amount of deformation at the second portion 101 just by adjusting Young's modulus, thickness, etc. on the elastomer side. For this reason, it is possible to adjust the amount of deformation of elastomer of the second portion 101 with a simple structure. Therefore, it is possible to prevent the advancement of creep deformation of the protrusion 93*a* due to excessive deformation at the second portion 101 and prevent poor sealing at the first portion 100 due to insufficient deformation at the second portion 101. In the present embodiment, the first rib 46, which is an example of "a restricting portion", is made of a rigid material, and the contact portion 93*b*, which is an example of "a to-be-restricted portion", is made of elastomer, which is a flexible elastic material. However, the scope of the present disclosure is not limited to this example. The first rib 46, which is an example of "a restricting portion", may be made of elastomer, which is a flexible elastic material, and the contact portion 93*b*, which is an example of "a to-be-restricted portion", may be made of a rigid material. Alternatively, both of the first rib 46, which is an example of "a restricting portion", and the contact portion 93*b*, which is an example of "a to-be-restricted portion", may be made of a rigid material or elastomer. When both of the first rib 46 and the contact portion 93*b* are made of a rigid material or elastomer, it is possible to adjust the amount of displacement at the second portion 101 easily by using materials that are different from each other in terms of Young's modulus. Alternatively, when both of the first rib 46 and the contact portion 93*b* are made of elastomer having the same Young's modulus, it is possible to adjust the amount of displacement at the second portion 101 easily by making the thickness of one of them in the contact direction different from the thickness of the other in the contact direction.

As illustrated in FIG. 5, it will be preferable if the total area size A1 of the first portion 100 where the protrusion 93*a* comes into contact with the valve seat 42 and the total area size A2 of the second portion 101 where the contact portion 93*b* comes into contact with the plurality of first ribs 46 satisfies a relation of A2>A1. The smaller the pressure-receiving area size is, the greater the magnitude of pressure is. Therefore, by making the total area size A1 of the first portion 100 smaller than the total area size A2 of the second portion 101, even in a state in which the movement of the valve 90 in the −Z direction is restricted at the second portion 101, it is possible to improve sealing performance at the first portion 100 by ensuring greater pressure at the first portion 100.

In addition, in the present embodiment, as illustrated in FIGS. 3 and 5, it will be preferable if the width W2 of the second portion 101 in the radial direction D of a virtual circle whose center lies at the center C of the valve 90 is greater than the width W1 of the first portion 100 in this radial direction D, as viewed in the −Z direction. That is, it will be preferable if a relation of W2>W1 is satisfied. The width W2 of the second portion 101 is the width of the first rib 46. The width W1 of the first portion 100 is a tight-contact width W1 formed by the protrusion 93*a* becoming deformed when coming into contact with the valve seat 42. By designing the width W2 of the second portion 101 to be greater than the width W1 of the first portion 100, it is possible to make the total area size A2 of the second portion 101 larger than the total area size A1 of the first portion 100 even though the second portion 101 is provided non-continuously in a split manner in the circumferential direction of the valve seat 42. Therefore, even when each communication path 46*a*, which defines the interval between the plurality of first ribs 46, is widened so as to decrease flow-passage resistance and enhance the ease of discharging air bubbles, it is possible to make the total area size A1 of the first portion 100 smaller than the total area size A2 of the second portion 101 by comparatively increasing the total area size A2 of the second portion 101.

It will be preferable if a relationship expressed by the following formula (1) is satisfied:

$$\frac{F1}{A1} + \frac{F2}{A2} < \frac{(P+\beta)}{A2}, \tag{1}$$

where A1 denotes the total area size of the first portion 100, F1 denotes the rubber reaction force of the elastic member 93, A2 denotes the total area size of the second portion 101, F2 denotes the rubber reaction force of the elastic member 93, β denotes the spring load of the coil spring 94, and P denotes the supply pressure of ink supplied from the inlet 48.

As expressed by the formula (1), in a valve-closed state, the sum of a force F1/A1 which the valve 90 receives by the elastic member 93 at the first portion 100 and a force F2/A2 which the valve 90 receives by the elastic member 93 at the second portion 101 is designed to be smaller than a force (P+β)/A2 which the valve 90 receives at the second portion 101 due to the spring load of the coil spring 94 and the supply pressure of ink. By satisfying the above relation, it is possible to ensure sufficient contact pressure of the protrusion 93*a* of the elastic member 93 and the valve seat 42 at the first portion 100 for reliable sealing at the first portion 100. If the opposite relation holds, that is, if the sum of the force F1/A1 received at the first portion 100 and the force F2/A2 received at the second portion 101 is larger than the force (P+β)/A2 which the valve 90 receives at the second portion 101 due to the spring load of the coil spring 94 and the supply pressure of ink, the contact pressure of the protrusion 93*a* of the elastic member 93 and the valve seat 42 at the first portion 100 will be lost. This makes it impossible to provide sealing at the first portion 100. Therefore, if this opposite relation holds, the valve will fail to fulfill its function.

Figure 10:
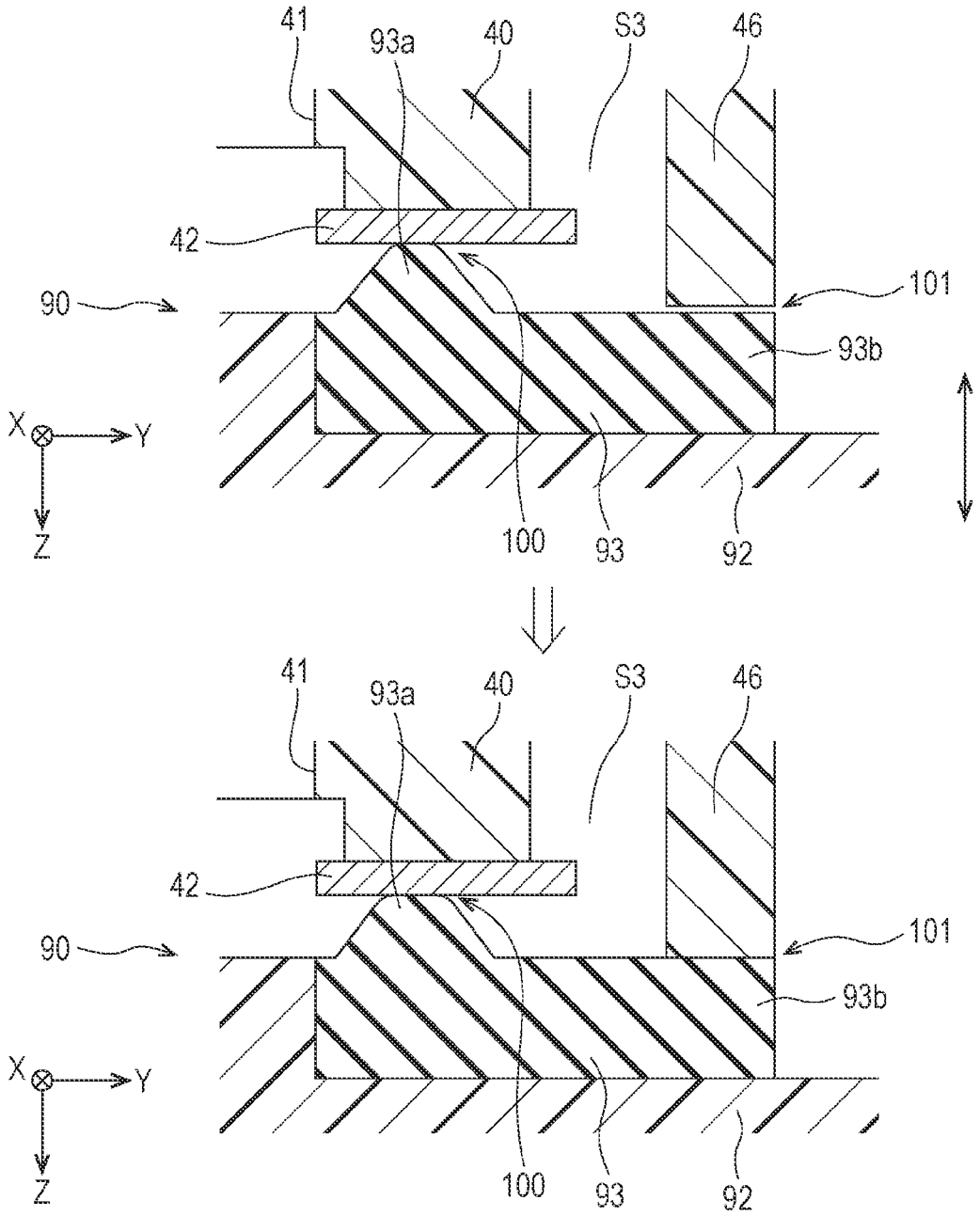
FIG. 10 is a cross-sectional view of the neighborhood of a first portion according to a modification example.

In the example described above, the first rib 46 is in contact with the contact portion 93*b* when in a valve-closed state, that is, in a state in which the protrusion 93*a* is in contact with the valve seat 42. However, the scope of the present disclosure is not limited to this example. FIG. 10 is a cross-sectional view of the neighborhood of the first portion 100 and the second portion 101, illustrating a valve-closed state in an initial phase and a valve-closed state after the lapse of time.

As illustrated in FIG. 10, the first rib 46 has such a length that, in an initial phase, the first rib 46 is not in contact with the contact portion 93*b* in a state in which the protrusion 93*a* is in contact with the valve seat 42 at the first portion 100, namely, in a valve-closed state. When the protrusion 93*a* has become creep-deformed slightly due to the lapse of time, the first rib 46 and the contact portion 93*b* are in contact with each other at the second portion 101 different from the first portion 100. As described here, even if the first rib 46 and the contact portion 93*b* are not in contact with each other in an initial phase, it is possible to restrict the movement of the valve 90 in the −Z direction by the contact of the first rib 46 and the contact portion 93*b* with each other when the protrusion 93*a* has become creep-deformed slightly due to the lapse of time; therefore, it is possible to prevent the advancement of creep deformation of the protrusion 93*a*.

As explained above, the pressure adjustment unit 30 according to the first embodiment of the present disclosure includes a flow passage that includes the first chamber 53, the second chamber 54, and the through hole 41 through which ink, an example of a liquid, flows from the first chamber 53 to the second chamber 54. The pressure adjustment unit 30 further includes the partition wall 40 which provides separation between the first chamber 53 and the second chamber 54 and through which the through hole 41 is formed, the elastic member 93 that is an example of a first sealing portion that has flexibility, and the valve seat 42 that is an example of a second sealing portion facing with the elastic member 93. The pressure adjustment unit 30 further includes the valve 90 that closes the flow passage by contact of the elastic member 93 and the valve seat 42 by moving in the −Z direction, which is a direction from the first chamber 53 toward the second chamber 54, and opens the flow passage by releasing the contact of the elastic member 93 and the valve seat 42 by moving in the +Z direction, which is the opposite of the −Z direction. The pressure adjustment unit 30 further includes the coil spring 94, which is an example of "a biasing member" and biases the valve 90 in the −Z direction. The pressure adjustment unit 30 further includes the first rib 46, which is an example of "a restricting portion" and restricts the movement of the valve 90 in the −Z direction by contact with the contact portion 93*b*, which is an example of "a to-be-restricted portion" of the valve 90, at the second portion 101 different from the first portion 100 where the elastic member 93 comes into contact with the valve seat 42.

Since the movement of the valve 90 in the −Z direction is restricted by providing the first rib 46 and the contact portion 93*b* as described above, the protrusion 93*a* of the elastic member 93 does not collapse excessively due to the urging of the valve 90 in the −Z direction by the urging force of the coil spring 94 and the supply pressure of ink supplied from the inlet 48, and it is possible to suppress the occurrence of so-called creep, which is a phenomenon of deformation increasing its degree in accordance with the lapse of time under the influence of persistent stress acting on the protrusion 93*a*. Therefore, it is less likely that the shape of the protrusion 93*a* after the lapse of time will be different from the shape of the protrusion 93*a* in the initial phase, and the position of the valve 90 along the Z axis after the lapse of time will not easily become shifted from that of the initial phase; therefore, it is possible to prevent variation in the internal pressure of the second chamber 54 that will be required for the opening of the valve and in the internal pressure after the closing of the valve from being caused by such a shift in the position of the valve 90, and it is possible to perform valve-opening operation and valve-closing operation under constant pressure.

Moreover, since the disclosed structure suppresses the occurrence of creep deformation of the protrusion 93*a*, it is possible to prevent variation in the protruding amount of the protrusion 93*a* in the −Z direction, that is, the amount of collapsing, between the state in the initial phase and the state after the lapse of time. Therefore, even after the lapse of time, the protrusion 93*a* will not become harder to deform. When a foreign object gets caught between the protrusion 93*a* and the valve seat 42, it will be easier for the protrusion 93*a* to deform along the foreign object. By this means, it is possible to prevent a decrease in a leak limit. Furthermore, since the disclosed structure suppresses the occurrence of creep deformation of the protrusion 93*a*, it is possible to prevent an increase in the hardness of the protrusion 93*a* and prevent a resultant decrease in the push-ability of the protrusion 93*a* onto the valve seat 42.

The pressure adjustment unit 30 according to the present embodiment further includes the inlet 48, through which ink, an example of a liquid, flows into the first chamber 53. In a state in which the elastic member 93, an example of the first sealing portion, is in contact with the valve seat 42, an example of the second sealing portion, and in which the first rib 46, an example of a restricting portion, is in contact with the contact portion 93*b*, an example of a to-be-restricted portion, it will be preferable if the space S3 between the first portion 100 and the second portion 101 is in communication with the inlet 48. If the space S3 is in communication with the inlet 48 as described here, it is possible to reduce flow-passage resistance.

In the pressure adjustment unit 30 according to the present embodiment, it will be preferable if either one of the first rib 46, which is an example of the restricting portion, and the contact portion 93*b*, which is an example of the to-be-restricted portion, is made of elastomer, and the other is made of a material having a higher Young's modulus than that of the elastomer of the one. In the present embodiment, the contact portion 93*b* is made of elastomer, and the first rib 46 is made of a rigid material having a higher Young's modulus than that of the elastomer. By using elastomer as the material of one of the restricting portion and the to-be-restricted portion and using a material having a higher Young's modulus than that of the elastomer as the material of the other, it is possible to prevent the valve 90 from becoming unable to move on the basis of the second portion 101. That is, even if a foreign object gets caught between the first rib 46 and the contact portion 93*b* or even if the valve 90 becomes tilted with respect to the Z axis, since the contact portion 93*b* is deformable, the valve 90 will not become unable to move on the basis of the second portion 101. Moreover, by using elastomer as the material of one of the restricting portion and the to-be-restricted portion and using a material having a higher Young's modulus than that of the elastomer as the material of the other, it is possible to adjust the amount of deformation at the second portion 101 just by adjusting Young's modulus, thickness, etc. on the elastomer side. For this reason, it is possible to adjust the amount of deformation of elastomer of the second portion 101 with a simple structure. Therefore, it is possible to prevent the advancement of creep deformation of the protrusion 93*a* due to excessive deformation at the second portion 101 and prevent poor sealing at the first portion 100 due to insufficient deformation at the second portion 101.

In the present embodiment, one of the restricting portion and the to-be-restricted portion is made of elastomer, and the other is made of a rigid material. However, the scope of the present disclosure is not limited to this example. The other may be made of elastomer having a higher Young's modulus than that of the elastomer of the one.

In the pressure adjustment unit 30 according to the present embodiment, it will be preferable if the total area size A2 of the second portion 101 is larger than the total area size A1 of the first portion 100 as viewed in the −Z direction. The smaller the pressure-receiving area size is, the greater the magnitude of pressure is. Therefore, by making the total area size A1 of the first portion 100 smaller than the total area size A2 of the second portion 101, even in a state in which the movement of the valve 90 in the −Z direction is restricted at the second portion 101, it is possible to improve sealing performance at the first portion 100 by ensuring greater pressure at the first portion 100.

In the pressure adjustment unit 30 according to the present embodiment, it will be preferable if the width W2 of the second portion 101 in the radial direction D of a virtual circle whose center lies at the center C of the valve 90 is greater than the width W1 of the first portion 100 in this radial direction D, as viewed in the −Z direction. With this preferred structure, even when the second portion 101 is made shorter in the circumferential direction to widen the communication path 46*a* between the first ribs 46 in the circumferential direction so as to decrease flow-passage resistance and enhance the ease of discharging air bubbles, it is possible to make the total area size A1 of the first portion 100 smaller than the total area size A2 of the second portion 101 easily.

In the pressure adjustment unit 30 according to the present embodiment, it will be preferable if the other of the restricting portion and the to-be-restricted portion is made of a rigid material. In the present embodiment, the first rib 46 is made of a rigid material. As described here, by using elastomer as the material of one of the restricting portion and the to-be-restricted portion and using a rigid material as the material of the other, it is possible to suppress the deformation of the other at the second portion 101 and adjust the amount of deformation at the second portion 101 just by adjusting Young's modulus, thickness, etc. on the elastomer side. For this reason, it is possible to adjust the amount of deformation of elastomer of the second portion 101 with a simple structure. Therefore, it is possible to prevent the advancement of creep deformation of the protrusion 93*a* due to excessive deformation at the second portion 101 and prevent poor sealing at the first portion 100 due to insufficient deformation at the second portion 101.

In the pressure adjustment unit 30 according to the present embodiment, it will be preferable if the contact portion 93*b*, which is a part of the elastic member 93 that is an example of the first sealing portion, constitutes the second portion 101. That is, the protrusion 93*a*, which constitutes the first portion 100, and the contact portion 93*b*, which constitutes the second portion 101, are formed in the same one member, namely, the elastic member 93. Since the elastic member 93, the same one member, can be used as a member having the protrusion 93*a* and the contact portion 93*b*, it is possible to reduce the number of parts and thus reduce cost.

In the pressure adjustment unit 30 according to the present embodiment, it will be preferable if the thickness t1 of the elastic member 93, which is an example of the first sealing portion, at the first portion 100 is greater than the thickness t2 of the elastic member 93 at the second portion 101. That is, preferably, the thickness t1 at the protrusion 93*a* constituting the first portion 100 is greater than the thickness t2 at the contact portion 93*b* constituting the second portion 101. Since the thickness t1 at the protrusion 93*a* is greater than the thickness t2 at the contact portion 93*b* in this preferred structure, it is possible to improve sealing performance at the first portion 100 by making the amount of displacement of the protrusion 93*a* larger than that of the contact portion 93*b*.

In the pressure adjustment unit 30 according to the present embodiment, it will be preferable if the restricting portion is the first rib 46 protruding from the partition wall 40 in the +Z direction. The first rib 46 extends in the +Z direction along the Z axis, which is the direction in which the valve 90 moves and in which the movement is restricted. Therefore, as compared with a structure in which the rib extends in a direction intersecting with the Z axis, it is possible to enhance rigidity to improve the durability of the first rib 46 and prevent the first rib 46 from becoming deformed.

The ink-jet recording apparatus 1, which is an example of a liquid ejecting apparatus according to the present disclosure, includes the pressure adjustment unit 30 described above, the liquid container 22, which is an example of a liquid containing unit that contains a liquid such as ink that is supplied to the first chamber 53 of the pressure adjustment unit 30, and the nozzle 28 from which the ink supplied from the second chamber 54 of the pressure adjustment unit 30 is ejected. Since the pressure adjustment unit 30 is capable of suppressing the creep deformation of the flexible member of either one of the first sealing portion and the second sealing portion, the shifting of the position of the valve 90 along the Z axis will not occur easily and, therefore, it is possible to prevent variation in the internal pressure of the second chamber 54 that will be required for the opening of the valve and in the internal pressure after the closing of the valve from being caused by such a shift in the position of the valve 90. For this reason, it is possible to perform valve-opening operation and valve-closing operation under constant pressure. Therefore, by making the supply pressure of ink supplied from the pressure adjustment unit 30 to the recording head 19 constant, it is possible to prevent variation in ejection characteristics of ink droplets ejected from the recording head 19, namely, variation in velocity of ejected ink droplets traveling in air, variation in ink droplet weight, and the like, resulting in improved print quality.

Moreover, since the disclosed structure suppresses the occurrence of creep deformation of the protrusion 93*a*, it is possible to prevent variation in the protruding amount of the protrusion 93*a* in the −Z direction, that is, the amount of collapsing, between the state in the initial phase and the state after the lapse of time. Therefore, even after the lapse of time, the protrusion 93*a* will not become harder to deform. When a foreign object gets caught between the protrusion 93*a* and the valve seat 42, it will be easier for the protrusion 93*a* to deform along the foreign object. By this means, it is possible to prevent a decrease in a leak limit. Furthermore, since the disclosed structure suppresses the occurrence of creep deformation of the protrusion 93*a*, it is possible to prevent an increase in the hardness of the protrusion 93*a* and prevent a resultant decrease in the push-ability of the protrusion 93*a* onto the valve seat 42.

Second Embodiment

Figure 11:
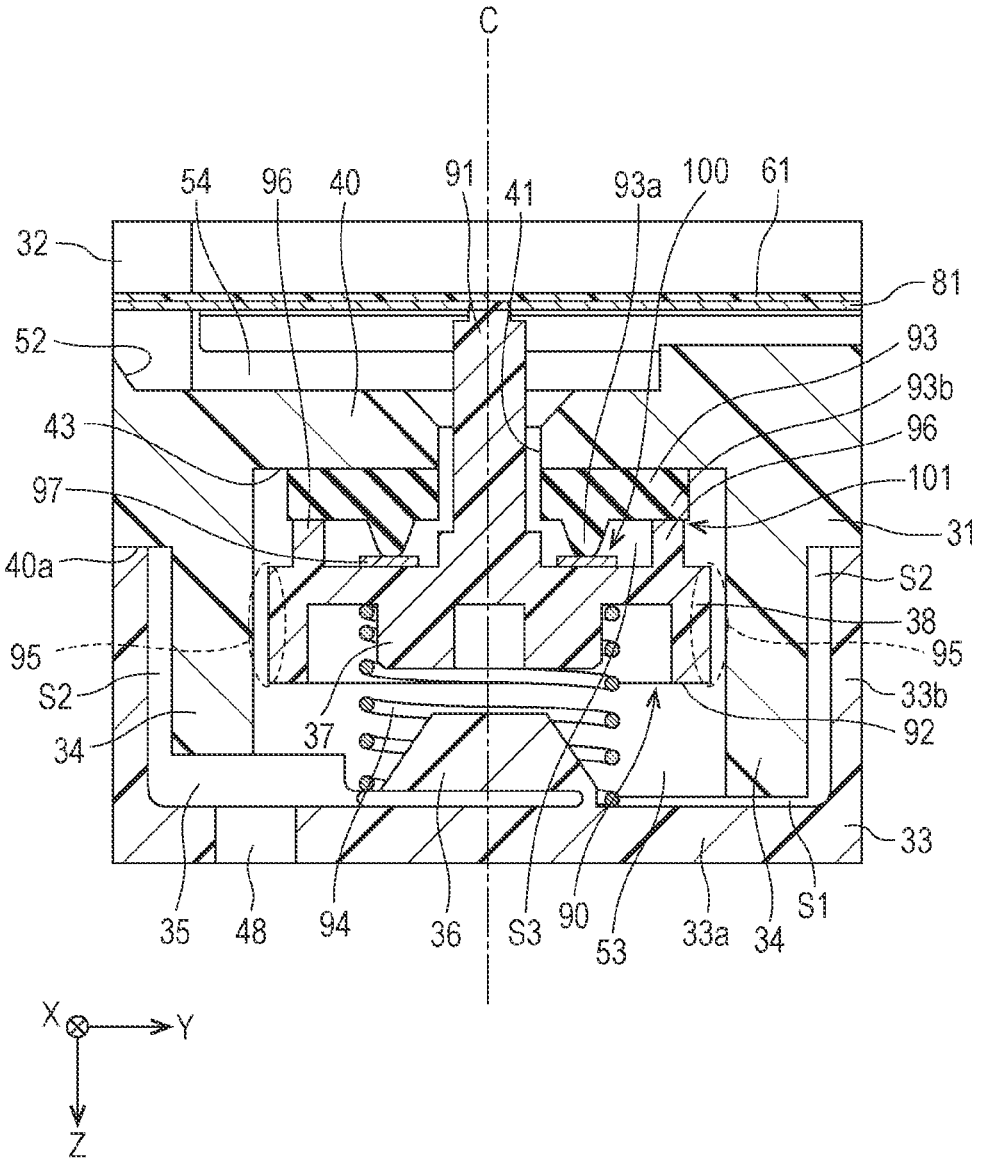
FIG. 11 is a cross-sectional view of an essential part of a pressure adjustment unit according to the second embodiment.

FIG. 11 is a cross-sectional view of the pressure adjustment unit 30 according to a second embodiment of the present disclosure. The same members as those described in the foregoing embodiment are labeled with the same reference numerals, and the same description will not be given.

As illustrated in FIG. 11, the valve 90 of the pressure adjustment unit 30 has a second rib 96 that protrudes from the base-end portion 92 of the valve 90 in the −Z direction. As the second rib 96, plural ribs are provided at intervals in the circumferential direction of the axial portion 91. Though not illustrated, similarly to the first ribs 46, two second ribs 96 are provided at symmetric positions with respect to the center C of the valve 90.

The elastic member 93 is provided at a position different from that of the first embodiment. Specifically, in the present embodiment, the elastic member 93 is fixed to, of the partition wall 40, the surface closer to the first chamber 53. The elastic member 93 has the protrusion 93*a* and the contact portion 93*b*, similarly to the first embodiment described above. The valve 90 further includes a receiving portion 97 fixed to the −Z-side surface of the base-end portion 92. The protrusion 93*a* and the receiving portion 97 serve as the first portion 100 for closing the through hole 41 by contact with each other. Therefore, in the present embodiment, the protrusion 93*a* of the elastic member 93 corresponds to "a valve seat" and "a first sealing portion", and the receiving portion 97 of the valve 90 corresponds to "a second sealing portion". The receiving portion 97 according to the present embodiment may be configured to have the same function as that of the valve seat 42 of the first embodiment by fixing the same member as the valve seat 42 of the first embodiment to the valve 90. Alternatively, the base-end portion 92 of the valve 90 itself may serve as the receiving portion 97. The second rib 96 comes into contact with the contact portion 93*b*, and the movement of the valve 90 in the −Z direction is restricted due to the contact. Therefore, in the present embodiment, the contact portion 93*b* of the elastic member 93 corresponds to "a restricting portion", and the second rib 96 corresponds to "a to-be-restricted portion". The second portion 101 is the portion where the second rib 96 comes into contact with the contact portion 93*b* of the elastic member 93.

As explained above, the pressure adjustment unit 30 according to the second embodiment of the present disclosure includes a flow passage that includes the first chamber 53, the second chamber 54, and the through hole 41 through which ink, an example of a liquid, flows from the first chamber 53 to the second chamber 54. The pressure adjustment unit 30 further includes the partition wall 40 which provides separation between the first chamber 53 and the second chamber 54 and through which the through hole 41 is formed, the elastic member 93 that is an example of a first sealing portion that has flexibility, and the receiving portion 97 that is an example of a second sealing portion facing with the elastic member 93. The pressure adjustment unit 30 further includes the valve 90 that closes the flow passage by contact of the elastic member 93 and the receiving portion 97 by moving in the −Z direction, which is a direction from the first chamber 53 toward the second chamber 54, and opens the flow passage by releasing the contact of the elastic member 93 and the receiving portion 97 by moving in the +Z direction, which is the opposite of the −Z direction. The pressure adjustment unit 30 further includes the coil spring 94, which is an example of "a biasing member" and biases the valve 90 in the −Z direction. The pressure adjustment unit 30 includes the contact portion 93*b*, which is an example of "a restricting portion" and restricts the movement of the valve 90 in the −Z direction by contact with the second rib 96, which is an example of "a to-be-restricted portion" of the valve 90, at the second portion 101 different from the first portion 100 where the receiving portion 97 comes into contact with the elastic member 93. That is, the to-be-restricted portion is the second rib 96 that protrudes from the valve 90 in the −Z direction.

Since the movement of the valve 90 in the −Z direction is restricted by providing the second rib 96 and the contact portion 93*b* as described above, the protrusion 93*a* of the elastic member 93 does not collapse excessively due to the urging of the valve 90 in the −Z direction by the urging force of the coil spring 94 and the supply pressure of ink supplied from the inlet 48, and it is possible to suppress the occurrence of so-called creep, which is a phenomenon of deformation increasing its degree in accordance with the lapse of time under the influence of persistent stress acting on the protrusion 93*a*. Therefore, the structure of the present embodiment produces the same, or similar, effects as those of the first embodiment described earlier.

Other Embodiments

Although some embodiments of the present disclosure are explained above, the basic structure of the present disclosure is not limited to those described above.

In the first embodiment described earlier, the partition wall 40 has the first rib 46. In the second embodiment described above, the valve 90 has the second rib 96. However, they may be combined with each other. That is, the movement of the valve 90 in the −Z direction may be restricted by the contact of the first rib 46 and the second rib 96 with each other. In this case, the first rib 46 corresponds to "a restricting portion", and the second rib 96 corresponds to "a to-be-restricted portion". Of course, the contact portion 93*b* made of elastomer may be provided on either one, or both, of the first rib 46 and the second rib 96. Either one of the first rib 46 and the second rib 96 may be made of elastomer.

Figure 12:
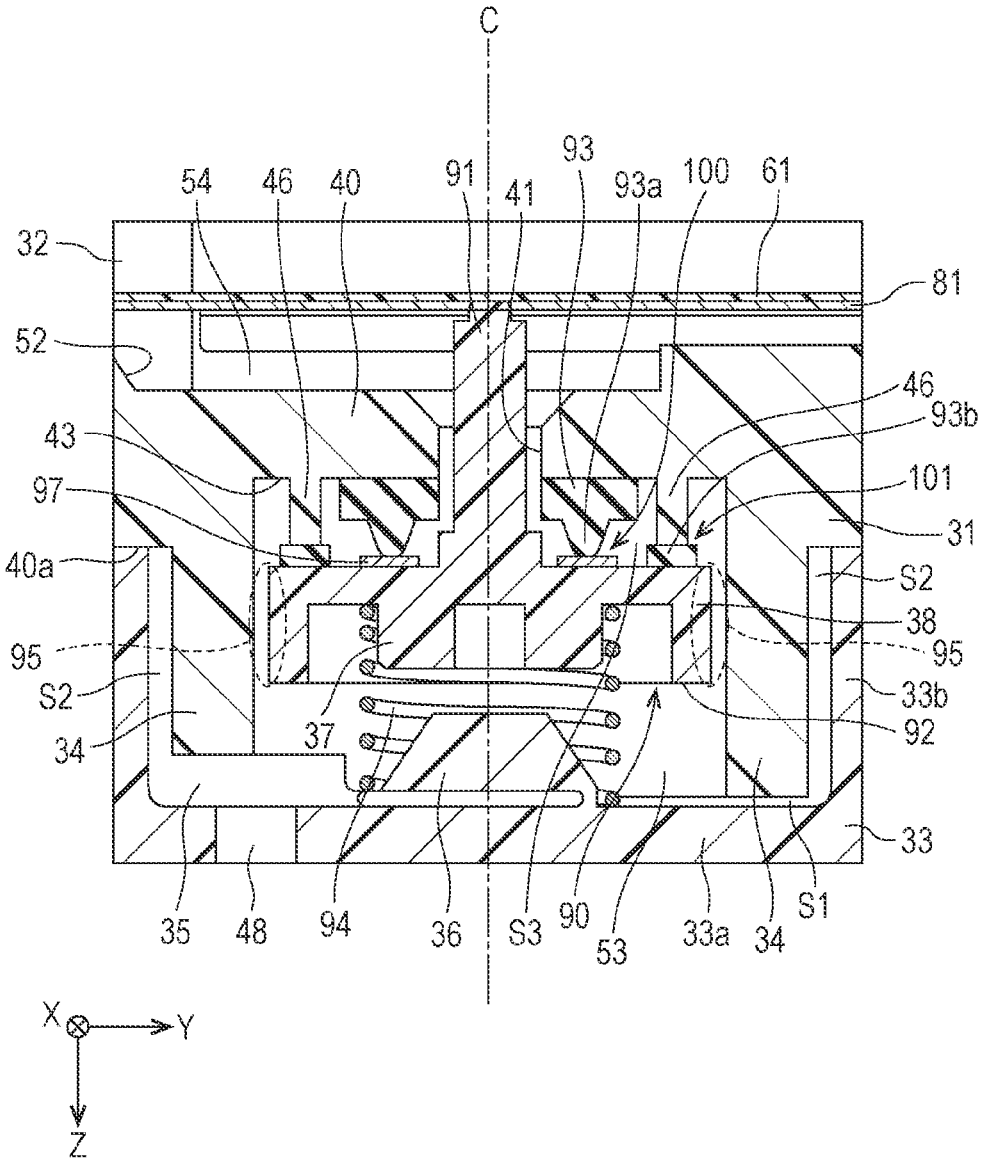
FIG. 12 is a cross-sectional view of an essential part of a pressure adjustment unit according to another embodiment.

In the first embodiment described earlier, for example, the elastic member 93 is provided on the valve 90, and the valve seat 42 is provided on the partition wall 40. However, the scope of the present disclosure is not limited to this example. For example, in FIG. 12, the receiving portion 97 is fixed to the −Z-side surface of the base-end portion 92 of the valve 90, and the elastic member 93 is fixed to the +Z-side surface of the partition wall 40. In this case, the protrusion 93*a* of the elastic member 93 serves as a valve seat. The first rib 46 protrudes from the partition wall 40 in the +Z direction, similarly to the first embodiment described earlier. The contact portion 93*b* is fixed to the −Z-side surface of the base-end portion 92 of the valve 90. That is, the contact portion 93*b* is separated from, meaning a not integral part of, the elastic member 93 that has the protrusion 93*a*. The structure of the present embodiment produces the same, or similar, effects as those of the first embodiment described earlier.

Figure 13:
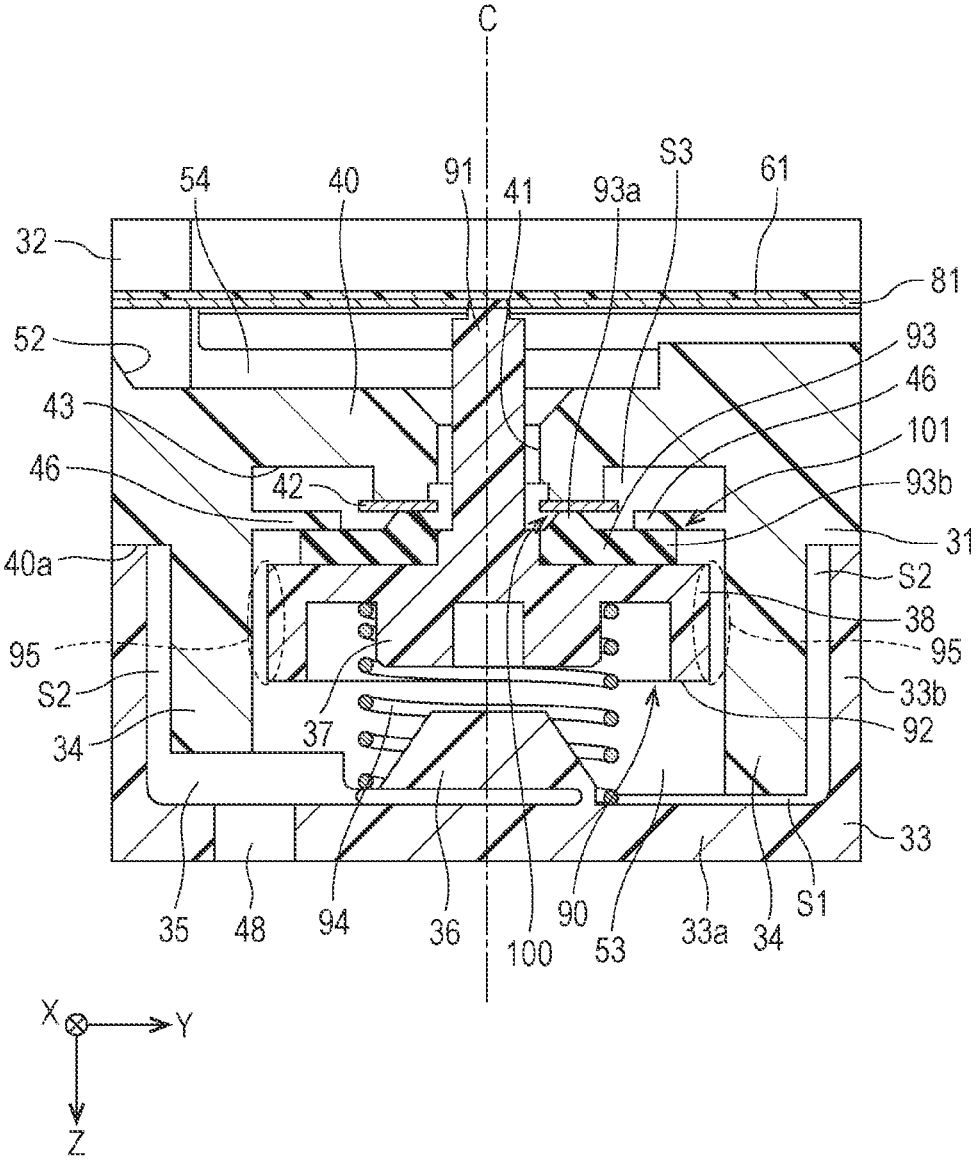
FIG. 13 is a cross-sectional view of an essential part of a pressure adjustment unit according to another embodiment.

In the first embodiment described earlier, for example, the first rib 46 that is an example of "a restricting portion" protrudes from the partition wall 40 in the +Z direction. However, the scope of the present disclosure is not limited to this example. For example, as illustrated in FIG. 13, the first rib 46 may protrude from the first wall portion 34 toward the center of the axial portion 91 of the valve 90 in a direction perpendicular to the Z axis. Though not illustrated, similarly to this modification example, the second rib 96 according to the second embodiment may be provided along the direction perpendicular to the Z axis. However, as is the case with the first rib 46 according to the first embodiment described earlier and the second rib 96 according to the second embodiment described above, it is better to provide the rib along the Z axis, that is, in the direction in which the valve 90 moves, than to provide the rib along the direction perpendicular to the Z axis because providing the rib along the Z axis makes it possible to enhance the rigidity of the rib and thus prevent the deformation of the rib.

Figure 14:
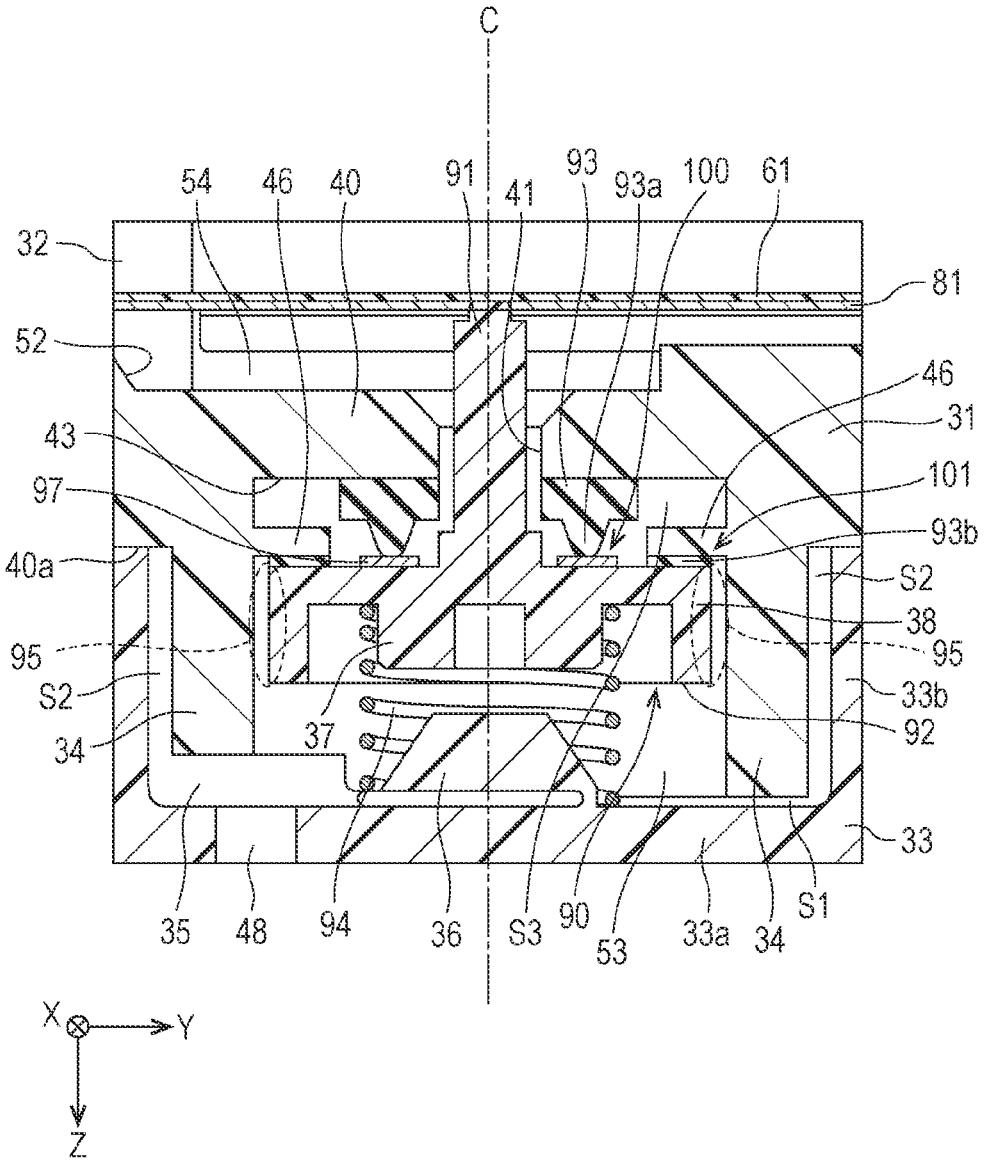
FIG. 14 is a cross-sectional view of an essential part of a pressure adjustment unit according to another embodiment.

In FIG. 13, the valve seat 42 is fixed to the partition wall 40, and the elastic member 93 having the protrusion 93*a* is fixed to the base-end portion 92 of the valve 90. However, the scope of the present disclosure is not limited to this example. For example, as illustrated in FIG. 14, even in a structure that includes the first rib 46 protruding in the direction perpendicular to the Z axis, the receiving portion 97 may be fixed to the −Z-side surface of the base-end portion 92 of the valve 90, and the elastic member 93 having the protrusion 93*a* may be fixed to the partition wall 40. In this case, the protrusion 93*a* of the elastic member 93 serves as a valve seat. The contact portion 93*b* configured to be in contact with the first rib 46 protruding from the first wall portion 34 in the direction perpendicular to the Z axis may be fixed to the −Z-side surface of the base-end portion 92 of the valve 90 or fixed to the +Z-side surface of the first rib 46. The structure of the present embodiment produces the same, or similar, effects as those of the first embodiment described earlier.

In each of the foregoing embodiments, for example, the valve seat 42 made of metal, or the receiving portion 97, is used as "a second sealing portion". However, the scope of the present disclosure is not limited to this example. The second sealing portion may be made of resin or elastomer. When "a second sealing portion" is made of elastomer, it will be preferable if the material of "a second sealing portion" has a Young's modulus different from that of "a first sealing portion". If a material that has a Young's modulus different from that of "a first sealing portion" is used for forming "a second sealing portion" as described here, it is possible to ensure tight contact at the first portion 100 where "a first sealing portion" and "a second sealing portion" are in contact with each other, thereby improving sealing performance. In the first embodiment described earlier, the valve seat 42 that is an example of "a second sealing portion" is a discrete member that is not an integral part of the partition wall 40. However, the surface of the partition wall 40 closer to the first chamber 53 may serve as "a second sealing portion", and the surface of the partition wall 40 closer to the first chamber 53 may serve as a valve seat with which the protrusion 93*a* of the elastic member 93 comes into contact.

In the first embodiment described earlier, the first rib 46 that is made of a rigid material is provided as an example of "a restricting portion", and the contact portion 93*b* that is made of elastomer is provided as an example of "a to-be-restricted portion". However, the scope of the present disclosure is not limited to this example. Both of "a restricting portion" and "a to-be-restricted portion" may be made of a rigid material. In the second embodiment, the contact portion 93*b* that is made of elastomer is provided as an example of "a restricting portion", and the second rib 96 that is made of a rigid material is provided as an example of "a to-be-restricted portion"; however, similarly, both of "a restricting portion" and "a to-be-restricted portion" may be made of a rigid material.

In each of the foregoing embodiments, the second portion 101 where the contact of "a restricting portion" and "a to-be-restricted portion" occurs is located outside the first portion 100. However, the scope of the present disclosure is not limited to this example. For example, the second portion 101 may be located inside the first portion 100, that is, at a position closer to the through hole 41. For example, the outer diameter of a part, of the axial portion 91, closer to the base-end portion 92 may be designed to be larger than the inner diameter of the through hole 41, and the movement of the valve 90 in the −Z direction may be restricted by the contact of the step formed by this outer-diameter difference of the axial portion 91 with the partition wall 40. It is sufficient as long as the contact portion 93*b* made of elastomer is provided on the partition wall 40 at the region where the step of the axial portion 91 comes into contact. In this case, the contact portion 93*b* corresponds to "a restricting portion", and the step of the axial portion 91 corresponds to "a to-be-restricted portion".

In each of the foregoing embodiments, the inlet 48 is provided at a +Z-side position in such a way as to face with the end of the first wall portion 34. However, the scope of the present disclosure is not limited to this example. The inlet 48 may be located at an inner position in comparison with the first wall portion 34. If the inlet 48 is located at an inner position in comparison with the first wall portion 34, the grooved portion 35 of the first wall portion 34 may be omitted.

In each of the foregoing embodiments, the head unit 18 that includes the recording head 19 and the pressure adjustment unit 30 is disclosed as an example. However, the scope of the present disclosure is not limited to this example. The pressure adjustment unit 30 may be included in the recording head 19. That is, the head unit 18 according to each of the foregoing embodiments may correspond to "a liquid ejecting head".

In the pressure adjustment unit 30 according to each of the foregoing embodiments, one inlet 48 and one outlet 47 are provided for the flow passage that includes the first chamber 53 and the second chamber 54. However, the scope of the present disclosure is not limited to this example. Two or more inlets 48 may be provided, and two or more outlets 47 may be provided. The number of the inlets 48 may be different from the number of the outlets 47.

In the foregoing examples, the ink-jet recording apparatus 1 has a structure in which the liquid containers 22, an example of a liquid containing unit, are mounted on the liquid container holder 21 of the body frame 12. However, the scope of the present disclosure is not limited to this example. Ink cartridges as an example of a liquid containing unit may be mounted on the carriage 15. The pressure adjustment unit 30 is not limited to those mounted on the carriage 15. The pressure adjustment unit 30 and the recording head 19 may be connected to each other via supply conduit members such as tubes.

The present disclosure is directed to a wide variety of liquid ejecting heads. For example, the disclosed technique can be used for a recording head such as various kinds of ink-jet recording head used in an image recording apparatus such as a printer or the like. The present disclosure can be applied to, besides such a recording head, a color material ejection head that is used in the production of color filters for a liquid crystal display, etc., an electrode material ejection head that is used for the electrode formation of an organic EL display, an FED (field emission display), etc., a living organic material ejection head that is used for production of biochips, etc.

Although the ink-jet recording apparatus 1 is taken as an example of a liquid ejecting apparatus, the disclosed technique can be used for a liquid ejecting apparatus using any other liquid ejecting head, including but not limited to those described above.

The present disclosure is directed to a wide variety of pressure adjustment units. The disclosed technique can be used for a liquid ejecting apparatus and other devices.

What is claimed is:

1. A pressure adjustment unit, comprising:

a flow passage including a first chamber, a second chamber, and a through hole through which a liquid flows from the first chamber to the second chamber;

a partition wall that separates between the first chamber and the second chamber and that the through hole is formed;

a first sealing portion having flexibility;

a second sealing portion facing with the first sealing portion;

a valve configured to close the flow passage by contact of the first sealing portion and the second sealing portion by moving in a first direction, which is a direction from the first chamber toward the second chamber, and to open the flow passage by releasing the contact of the first sealing portion and the second sealing portion by moving in a second direction opposite to the first direction;

a biasing member biasing the valve in the first direction; and a restricting portion restricting movement of the valve in the first direction by contact with a to-be-restricted portion of the valve, at a second portion different from a first portion where the contact of the first sealing portion and the second sealing portion occurs.

2. The pressure adjustment unit according to claim 1, further comprising:

an inlet through which a liquid flows into the first chamber; wherein in a state in which the first sealing portion is in contact with the second sealing portion, and in which the restricting portion is in contact with the to-be-restricted portion, a space between the first portion and the second portion is in communication with the inlet.

3. The pressure adjustment unit according to claim 1, wherein either one of the restricting portion and the to-be-restricted portion is made of elastomer, and an other is made of a material having a higher Young's modulus than that of the elastomer of the one.

4. The pressure adjustment unit according to claim 3, wherein a total area size of the second portion is larger than a total area size of the first portion as viewed in the first direction.

5. The pressure adjustment unit according to claim 4, wherein a width of the second portion in a radial direction of a virtual circle whose center lies at a center of the valve is greater than a width of the first portion in the radial direction, as viewed in the first direction.

6. The pressure adjustment unit according to claim 3, wherein the other is made of a rigid material.

7. The pressure adjustment unit according to claim 1, wherein a part of the first sealing portion constitutes the second portion.

8. The pressure adjustment unit according to claim 7, wherein a thickness of the first sealing portion at the first portion is greater than a thickness of the first sealing portion at the second portion.

9. The pressure adjustment unit according to claim 1, wherein the restricting portion is a first rib protruding from the partition wall in the second direction.

10. The pressure adjustment unit according to claim 1, wherein the to-be-restricted portion is a second rib protruding from the valve in the first direction.

11. A liquid ejecting head, comprising:

the pressure adjustment unit according to claim 1; and a nozzle configured to eject a liquid supplied from the second chamber of the pressure adjustment unit.

12. A liquid ejecting apparatus, comprising:

the pressure adjustment unit according to claim 1;

a liquid containing unit that contains a liquid that is supplied to the first chamber of the pressure adjustment unit; and a nozzle configured to eject a liquid supplied from the second chamber of the pressure adjustment unit.

* * * * *